US011566870B1

(12) United States Patent
Pennington et al.

(10) Patent No.: US 11,566,870 B1
(45) Date of Patent: Jan. 31, 2023

(54) BOW AIM SIGNAL CONVERTER

(71) Applicant: ARES Archery Ltd., Niwot, CO (US)

(72) Inventors: Tony Alton Pennington, Amarillo, TX (US); Shawn Heimbigner, Amarillo, TX (US); Dante Schlomer, Amarillo, TX (US); Clinton Sigg, Niwot, CO (US)

( * ) Notice: Subject to any disclaimer, the term of this patent is extended or adjusted under 35 U.S.C. 154(b) by 0 days.

(21) Appl. No.: 17/813,498

(22) Filed: Jul. 19, 2022

Related U.S. Application Data

(60) Provisional application No. 63/228,080, filed on Jul. 31, 2021.

(51) Int. Cl.
*F41G 1/467* (2006.01)

(52) U.S. Cl.
CPC ..... *F41G 1/467* (2013.01)

(58) Field of Classification Search
CPC ..... F41G 1/467
See application file for complete search history.

(56) References Cited

U.S. PATENT DOCUMENTS

| | | | | |
|---|---|---|---|---|
| 6,016,608 | A | 1/2000 | LoRocco | |
| 6,079,111 | A | 6/2000 | Williams | |
| 6,216,352 | B1 | 4/2001 | LoRocco | |
| 6,494,604 | B2 | 12/2002 | Khoshnood | |
| 6,634,111 | B2 | 10/2003 | LoRocco | |
| 6,817,105 | B2 | 11/2004 | LoRocco | |
| 7,562,486 | B2 | 7/2009 | LoRocco | |
| 7,574,810 | B1 | 8/2009 | LoRocco | |
| 7,614,156 | B1 | 11/2009 | Imig | |
| 7,739,825 | B2 | 6/2010 | LoRocco | |
| 7,886,448 | B2 | 2/2011 | Humpert | |
| 8,122,874 | B2 | 2/2012 | LoRocco | |
| 8,276,541 | B2 | 10/2012 | LoRocco | |
| 8,316,551 | B2 * | 11/2012 | Gorsuch | F41G 1/467 124/87 |
| 8,393,109 | B2 | 3/2013 | Gilmore | |
| 8,434,467 | B2 | 5/2013 | LoRocco | |
| 8,453,336 | B2 | 6/2013 | LoRocco | |
| 8,500,563 | B2 | 8/2013 | Roman | |
| 8,522,765 | B1 | 9/2013 | LoRocco | |
| 8,522,766 | B2 | 9/2013 | LoRocco | |
| 8,534,273 | B2 | 9/2013 | LoRocco | |
| 8,544,458 | B1 | 10/2013 | LoRocco | |
| D702,795 | S | 4/2014 | Webb | |
| 8,695,577 | B2 | 4/2014 | LoRocco | |
| 8,695,580 | B2 | 4/2014 | LoRocco | |

(Continued)

*Primary Examiner* — Yaritza Guadalupe-McCall
(74) *Attorney, Agent, or Firm* — Shannon Warren

(57) ABSTRACT

A range finder assembly comprising one or more sight pin leads having a light emitting end and a light receiver end, one or more PCBs, a range finder assembly, one or more LEDs, a power supply, a device application and an optical coupling assembly. The one or more PCBs comprises one or more processors and a memory. The one or more processors are configured for executing the device application. The device application is configured for interpreting a range signal from the range finder assembly and generating a range display signal. The one or more LEDs generate light signals. The one or more LEDs are selectively routed into the light receiver end of the one or more sight pin leads using the optical coupling assembly. The light emitting end connect to one or more display pins within bow sight.

20 Claims, 18 Drawing Sheets

(56) References Cited

U.S. PATENT DOCUMENTS

| | | | | |
|---|---|---|---|---|
| 8,713,807 | B2 * | 5/2014 | LoRocco | F41G 1/345 362/110 |
| D708,289 | S | 7/2014 | Coalson | |
| 8,839,777 | B1 | 9/2014 | Webb | |
| 8,869,784 | B2 | 10/2014 | LoRocco | |
| 8,879,146 | B2 | 11/2014 | LoRocco | |
| 9,121,676 | B1 | 9/2015 | Coalson | |
| 9,151,567 | B1 | 10/2015 | Estridge | |
| 9,163,897 | B1 | 10/2015 | Estridge | |
| 9,243,862 | B1 | 1/2016 | Webb | |
| 9,243,863 | B1 | 1/2016 | Coalson | |
| 9,285,188 | B1 | 3/2016 | LoRocco | |
| 9,395,144 | B1 | 7/2016 | LoRocco | |
| 9,448,036 | B2 | 9/2016 | Samuels | |
| 9,464,869 | B1 | 10/2016 | LoRocco | |
| 9,500,434 | B1 | 11/2016 | LoRocco | |
| 9,568,266 | B1 | 2/2017 | LoRocco | |
| 9,568,270 | B1 | 2/2017 | LoRocco | |
| 9,593,907 | B2 * | 3/2017 | Regan | F41G 1/30 |
| 9,644,921 | B1 | 5/2017 | LoRocco | |
| 9,651,330 | B1 | 5/2017 | LoRocco | |
| 9,797,686 | B2 | 10/2017 | Chesney | |
| 9,810,504 | B1 | 11/2017 | LoRocco | |
| 9,933,229 | B2 | 4/2018 | Coalson | |
| 9,970,729 | B1 | 5/2018 | Coalson | |
| 11,199,378 | B2 | 12/2021 | LoRocco | |
| 2011/0296699 | A1 | 12/2011 | Mainsonneuve | |
| 2013/0133213 | A1 * | 5/2013 | Gorsuch | F41G 1/467 33/265 |
| 2015/0040409 | A1 * | 2/2015 | Morrison | F41G 1/35 33/228 |
| 2015/0330742 | A1 * | 11/2015 | Overstreet | F41G 1/467 356/4.01 |
| 2016/0231083 | A1 * | 8/2016 | Regan | F41G 3/06 |
| 2016/0282086 | A1 * | 9/2016 | Morrison | F41B 5/1492 |
| 2018/0128574 | A1 * | 5/2018 | Crispin | G02B 23/105 |
| 2021/0348886 | A1 * | 11/2021 | Havens | F41G 1/38 |

* cited by examiner

Memory
338

Device Application 1540

| Pin No. 1506 | Pin Range 1504 |
|---|---|
| 1 | 10 |
| 2 | 20 |
| 3 | 30 |
| 4 | 40 |
| 5 | 50 |
| 6 | 60 |
| 7 | 70 |
| 8 | 80 |

| Signal No. 1512 | Tolerance 1514 | Display 1516 |
|---|---|---|
| 1 | 5 | Solid |
| 2 | 8 | Blink |

1510

1500

1500

| Pin No. 1506 | Pin Range 1504 |
|---|---|
| 1 | 10 |
| 2 | 20 |
| 3 | 30 |
| 4 | 40 |
| 5 | 50 |
| 6 | 60 |
| 7 | 70 |
| 8 | 80 |

FIG. 17A

1510

| Signal No. 1512 | Tolerance 1514 | Display 1516 |
|---|---|---|
| 1 | 5 | Solid |
| 2 | 8 | Blink |

FIG. 17B

1700

| Range 1702 | Pin 1 (1704a) | Pin 2 (1704b) | Pin 3 (1704c) | Pin 4 (1704d) | Pin 5 (1704e) | Pin 6 (1704f) | Pin 7 (1704g) | Pin 8 (1704h) |
|---|---|---|---|---|---|---|---|---|
| 79 | | | | | | | | Solid |
| 39 | | | | Solid | | | | |
| 14 | Solid | Blink | | | | | | |
| 48 | | | | | Solid | | | |
| 22 | | Solid | | | | | | |
| 68 | | | | | | | Solid | |
| 24 | | Solid | Blink | | | | | |
| 66 | | | | | | Blink | Solid | |

FIG. 17C

1500

| Pin No. 1506 | Pin Range 1504 |
|---|---|
| 1 | 10 |
| 2 | 20 |
| 3 | 30 |
| 4 | 40 |
| 5 | 50 |
| 6 | 60 |
| 7 | 70 |
| 8 | 80 |

FIG. 18A

1510

| Signal No. 1512 | Tolerance 1514 | Display 1516 |
|---|---|---|
| 1 | 5 | Green |
| 2 | 8 | Yellow |

FIG. 18B

1700

| Range 1702 | Pin 1 (1704a) | Pin 2 (1704b) | Pin 3 (1704c) | Pin 4 (1704d) | Pin 5 (1704e) | Pin 6 (1704f) | Pin 7 (1704g) | Pin 8 (1704h) |
|---|---|---|---|---|---|---|---|---|
| 48 | | | | | Green | | | |
| 60 | | | | | | Green | | |
| 75 | | | | | | | Yellow | Yellow |
| 76 | | | | | | | Yellow | Green |
| 46 | | | | Yellow | Green | | | |
| 38 | | | | Green | | | | |
| 79 | | | | | | | | Green |
| 20 | | Green | | | | | | |

FIG. 18C

BOW AIM SIGNAL CONVERTER

CROSS-REFERENCE TO RELATED APPLICATIONS

This application claims benefit to U.S. provisional patent application No. 63/228,080 filed 20221-07-31.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

No prior art relevant to the claims of the application is known to the Applicant. However, these references were found while researching this project and represent an introduction to the art known by one of skill in the art: 2022018628, U.S. Pat. Nos. 9,933,229, 9,970,729, 9,121,676, 9,243,863, D708289, 9,163,897, 9,151,567, U.S. Ser. No. 11/199,378, U.S. Pat. Nos. 9,500,434, 9,568,270, 9,644,921, 9,464,869, 9,568,266, 9,651,330, 9,810,504, 9,395,144, 9,285,188, 8,522,765, 8,544,458, 8,869,784, 8,695,577, 8,453,336, 8,534,273, 8,522,766, 8,276,541, 8,879,146, 8,695,580, 8,122,874, 8,434,467, 7,562,486, 7,574,810, 7,739,825, 6,817,105, 6,634,111, 6,216,352, 6,016,608, 9,243,862, 8,839,777, and US-D702795. These and other references are disclosed in the information disclosure statement associated with this application.

BRIEF SUMMARY OF THE INVENTION

A range finder assembly for coupling one or more display pins with one or more LEDs, measuring a distance to a target and displaying a range display signal on said one or more display pins is disclosed. Comprising said range finder assembly comprising one or more sight pin leads having a light emitting end and a light receiver end, one or more PCBs, a range finder assembly, said one or more LEDs, a power supply, a device application and an optical coupling assembly. Said one or more PCBs comprises one or more processors and a memory. Said one or more processors are configured for executing said device application. Said device application is configured for interpreting a range signal from said range finder assembly and generating said range display signal. Said one or more LEDs generate light signals. Said one or more LEDs are selectively routed into said light receiver end of said one or more sight pin leads using said optical coupling assembly. Said light emitting end connect to said one or more display pins within bow sight. each among said one or more display pins correspond to a bow sight aiming point of said bow sight. Said device application is configured to associate each among said one or more display pins and said one or more LEDs with a pin number and a pin range. Said range finder assembly is configured to communicate a summary of said range signal to said bow sight by sending said range display signal to said one or more LEDs, displaying said range display signal using said light signals on said one or more LEDs, routing said light signals into said light receiver end of said one or more sight pin leads using said optical coupling assembly, and displaying said range display signal on said one or more display pins. An LED surround is configured to slide around a portion of said one or more LEDs and hold a portion of said one or more LEDs at one end and a portion of a plurality of lead tunnels at another end. Said LED surround and lead receiver squeeze assembly comprises a material selected among neoprene and rubber. Said LED surround snuggly fitting around said plurality of lead tunnels and said one or more LEDs. Said lead receiver squeeze assembly can snuggly fit around a plurality of optical line holders and said plurality of lead tunnels. A lead receiver assembly is configured for receiving and holding said light receiver end of said one or more sight pin leads in alignment with one among said one or more LEDs.

Said range finder assembly for coupling said one or more display pins with said one or more LEDs, measuring a distance to said target and displaying said range display signal on said one or more display pins is disclosed. Comprising said range finder assembly comprising said one or more sight pin leads having said light emitting end and said light receiver end, said one or more PCBs, said range finder assembly, said one or more LEDs, said power supply, said device application and said optical coupling assembly. Said one or more PCBs comprises said one or more processors and said memory. Said one or more processors are configured for executing said device application. Said device application is configured for interpreting said range signal from said range finder assembly and generating said range display signal. Said one or more LEDs generate said light signals. Said one or more LEDs are selectively routed into said light receiver end of said one or more sight pin leads using said optical coupling assembly. Said light emitting end connect to said one or more display pins within said bow sight. each among said one or more display pins correspond to said bow sight aiming point of said bow sight. Said device application is configured to associate each among said one or more display pins and said one or more LEDs with said pin number and said pin range. Said range finder assembly is configured to communicate a summary of said range signal to said bow sight by sending said range display signal to said one or more LEDs, displaying said range display signal using said light signals on said one or more LEDs, routing said light signals into said light receiver end of said one or more sight pin leads using said optical coupling assembly, and displaying said range display signal on said one or more display pins.

Said range finder assembly for coupling said one or more display pins with said one or more LEDs, measuring a distance to said target and displaying said range display signal on said one or more display pins is disclosed. Comprising said range finder assembly comprising said one or more sight pin leads having said light emitting end and said light receiver end, said one or more PCBs, said range finder assembly, said one or more LEDs, said power supply, said device application and said optical coupling assembly. Said one or more PCBs comprises said one or more processors and said memory. Said one or more processors are configured for executing said device application. Said device application is configured for interpreting said range signal from said range finder assembly and generating said range display signal. Said one or more LEDs generate said light signals. Said one or more LEDs are selectively routed into said light receiver end of said one or more sight pin leads using said optical coupling assembly. Said light emitting end connect to said one or more display pins within said bow sight. each among said one or more display pins correspond to said bow sight aiming point of said bow sight. Said device application is configured to associate each among said one or more display pins and said one or more LEDs with said pin number and said pin range. Said range finder assembly is configured to communicate a summary of said range signal to said bow sight by sending said range display signal to said one or more LEDs, displaying said range display signal using said light signals on said one or more LEDs, routing said light signals into said light receiver end of said one or more sight pin leads using said optical coupling assembly, and displaying said range display signal on said one or more display pins. Said optical coupling assembly comprises said plurality of optical line holders, said plurality of lead tunnels, and said LED surround. Said one or more LEDs is integrated into a primary PCB. A plurality of LED apertures in said LED surround can connect to said one or more LEDs on one side and said plurality of lead tunnels on another side. Said plurality of lead tunnels can connect to said LED surround on one side and said plurality of optical line holders on another side. Said plurality of lead tunnels comprises a light cavity for coupling said light receiver end with said one or more LEDs. and said plurality of optical line holders can enclose said plurality of lead tunnels to ensure light from one among said one or more LEDs does not pollute another.

BRIEF DESCRIPTION OF THE SEVERAL VIEWS OF THE DRAWING

FIGS. 17A, 17B and 17C illustrate said pin range chart 1500, a signal and range tolerance table 1510 and an example range display signal table 1700.

FIGS. 18A, 18B and 18C illustrate said pin range chart 1500, said signal and range tolerance table 1510 and an example range display signal table 1800.

DETAILED DESCRIPTION OF THE INVENTION

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
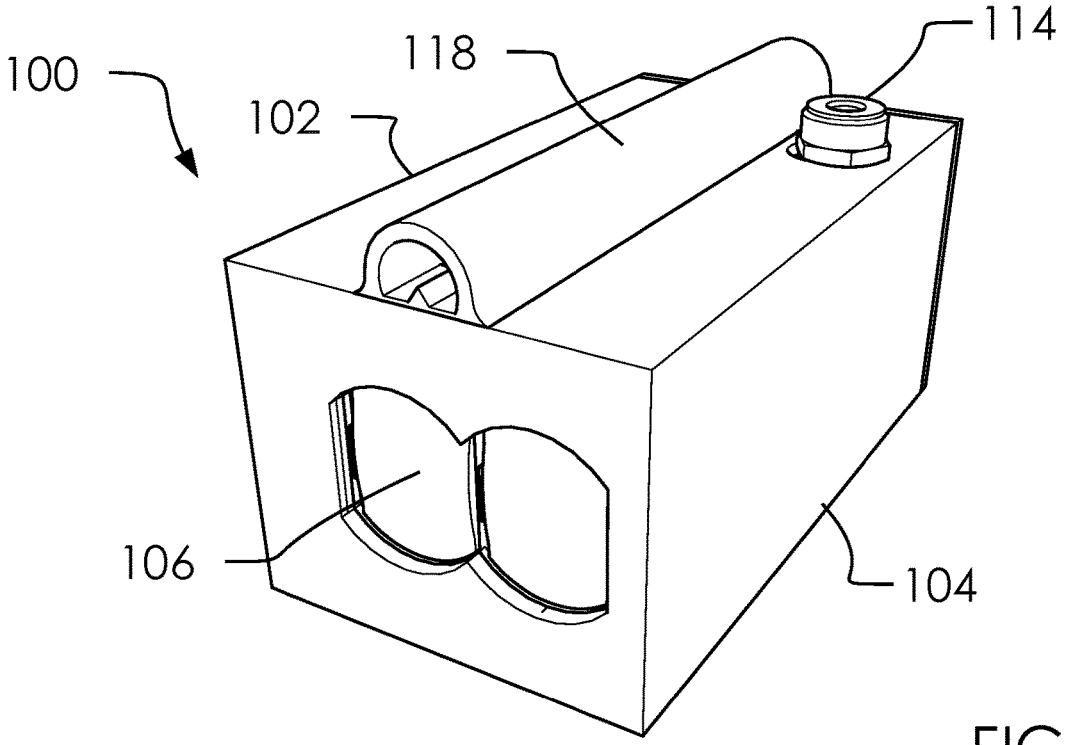
FIGS. 1A and 1B illustrate a perspective front overview and rear lower view of a range finder assembly 100.
Figure 1B:
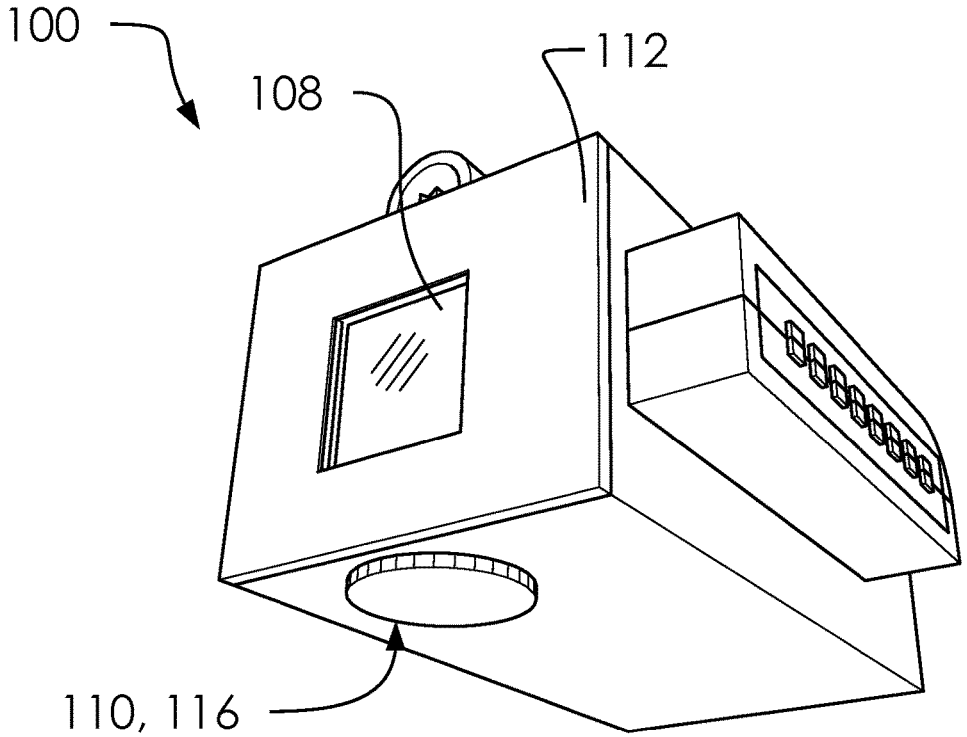

FIGS. 1A and 1B illustrate a perspective front overview and rear lower view of a range finder assembly 100.

In one embodiment, said range finder assembly 100 can comprise a housing 102, an optical coupling assembly 104, a range finder assembly 106, a display 108, and one or more button jacks 114. In one embodiment, said housing 102 can comprise a battery compartment 110, a battery door 116, an alignment scope 118 and a display bezel 112.

In one embodiment, said one or more button jacks 114 can communicate with an activation button comprising a push button to request distance and correct pin to be displayed.

In one embodiment, said display 108 can be configured to output messages to a user of said range finder assembly 100. In one embodiment, said display window can comprise an LCD screen, as is known in the art.

Figure 2:
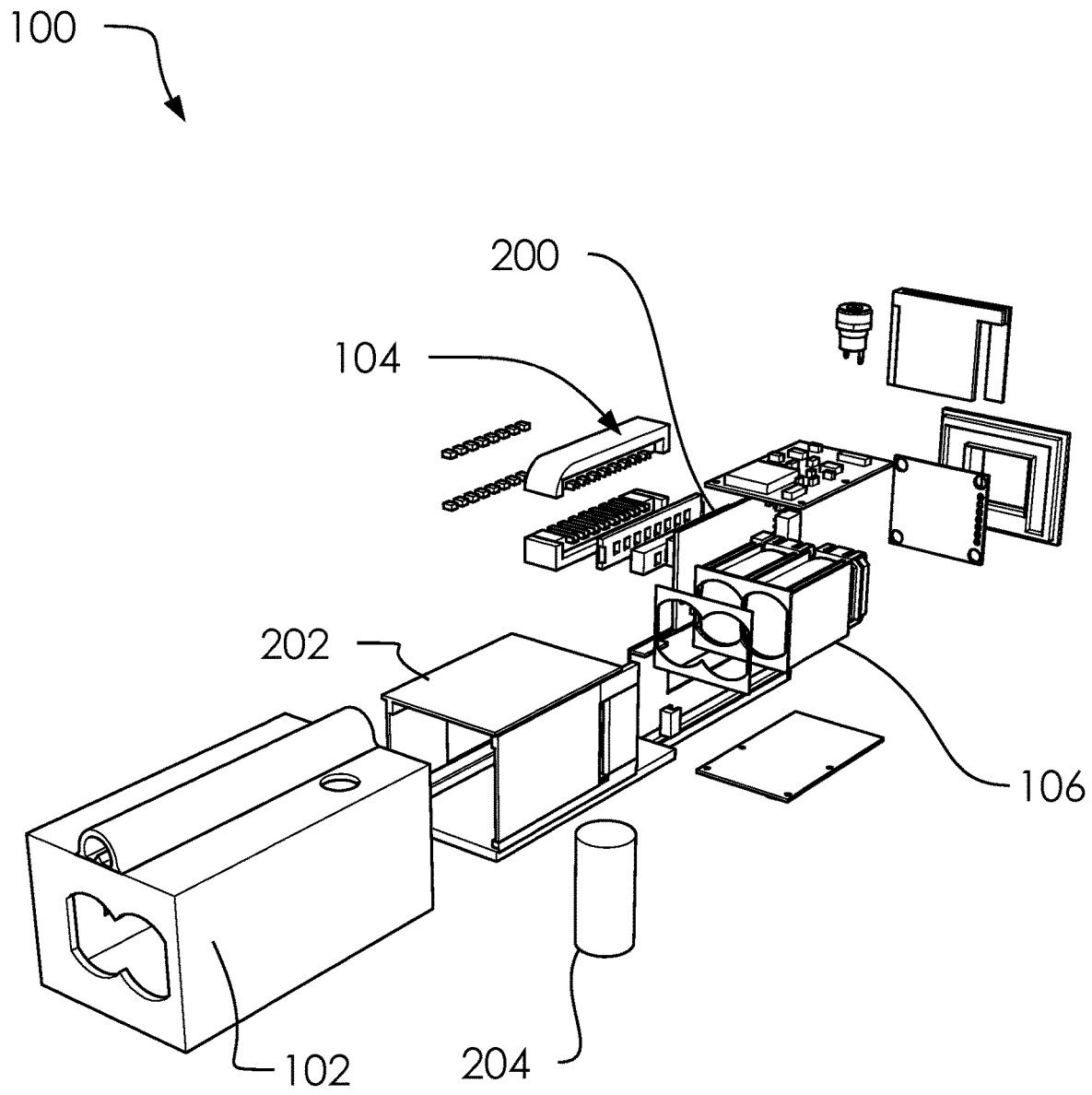
FIG. 2 illustrates an exploded perspective overview of said range finder assembly 100.

FIG. 2 illustrates an exploded perspective overview of said range finder assembly 100.

Said range finder assembly 100 can further comprise one or more PCBs 200, a mounting bracket 202, and a power supply 204.

In one embodiment, said power supply 204 can comprise a battery.

Figure 3:
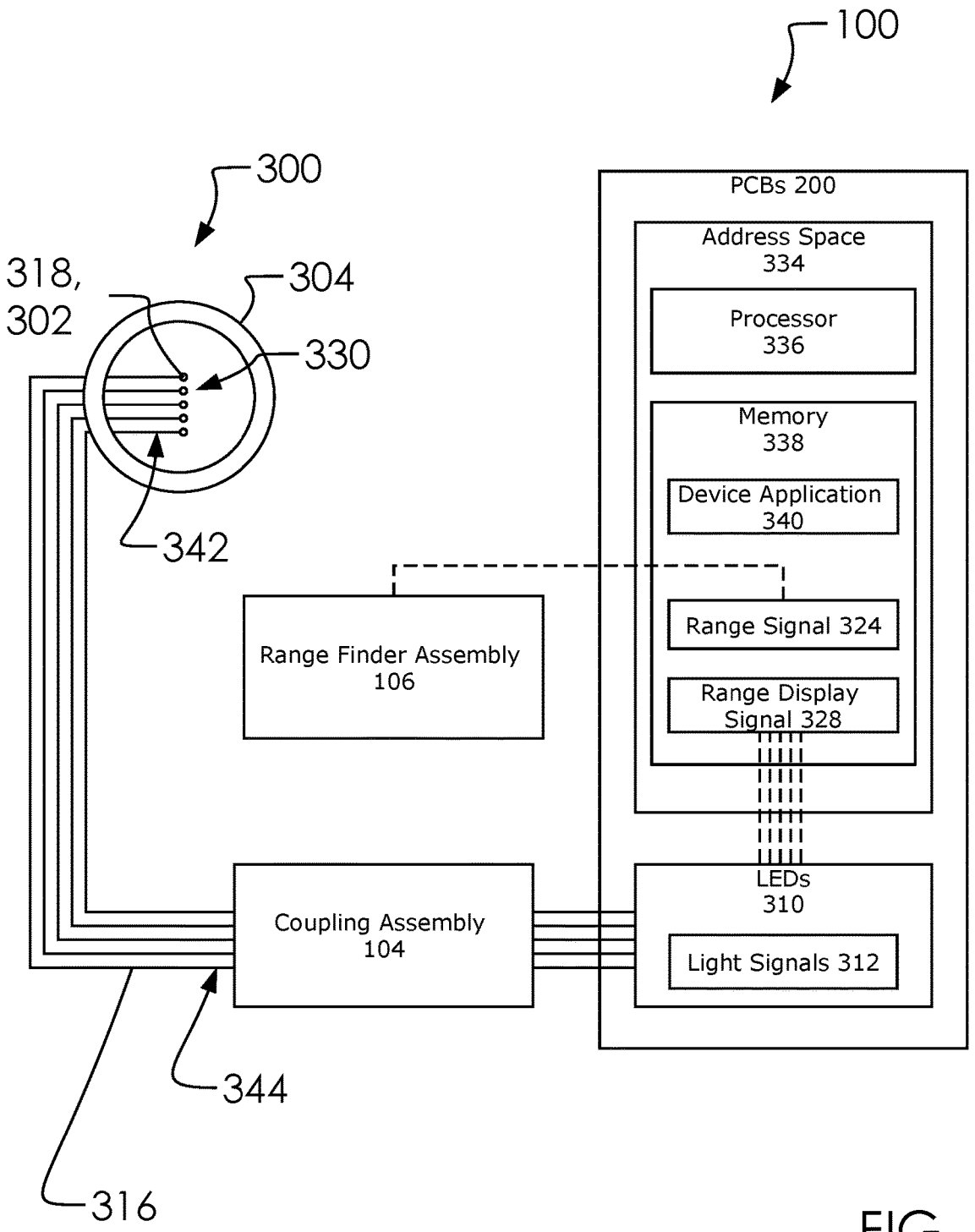
FIG. 3 illustrates a block diagram of said range finder assembly 100 with bow sight 300.

FIG. 3 illustrates a block diagram of said range finder assembly 100 with bow sight 300.

In one embodiment, said bow sight 300 can comprise one or more display pins 302 surrounded in part by sight bracket 304.

In one embodiment, said one or more PCBs 200 can be configured to communicate with said range finder assembly 106 and one or more LEDs 310.

In one embodiment, one or more sight pin leads 316 can comprise a light receiver end 344 and a light emitting end 342.

In one embodiment, said optical coupling assembly 104 can be configured to route light signals 312, generated by said one or more LEDs 310, into a portion of said one or more sight pin leads 316. In one embodiment, each among said one or more sight pin leads 316 can be connected to said optical coupling assembly 104 at said light receiver end 344 and said one or more display pins 302 at said light emitting end 342.

In one embodiment, a portion of said one or more display pins 302 having been lighted up by said range finder assembly 100 is referred to as one or more illuminated pins 318.

In one embodiment, said range finder assembly 100 can be configured for sending a range signal 324 to said one or more illuminated pins 318 from said one or more LEDs 310 through said optical coupling assembly 104.

In one embodiment, said one or more PCBs 200 can comprise an address space 334 comprising a computing platform for receiving, processing and sending signals, having at least one or more processors 336 and a memory 338. Said range finder assembly 100 can comprise a device application 340 configured for: receiving data such as said range signal 324, processing such data on said one or more processors 336, and generating a range display signal 328.

In one embodiment, said device application 340 on said one or more processors 336 can interpret said range signal 324 and generate said range display signal 328. Said range finder assembly 100 can be configured communicate a useful interpretation of said range signal 324 to said sight bracket 304 by: sending send said range display signal 328 to said one or more LEDs 310, generating said light signals 312 using said one or more LEDs 310 associated with said range display signal 328, routing said light signals 312 into said one or more sight pin leads 316 using said optical coupling assembly 104, and displaying said range display signal 328 on said one or more illuminated pins 318 among said address space 334.

In one embodiment, said one or more illuminated pins 318 and said one or more sight pin leads 316 can comprise fiberoptic lines.

As is known in the art, said one or more illuminated pins 318 can comprise a bow sight aiming point 330.

In one embodiment, said device application 340 can attach to said optical coupling assembly 104 to receive said light signals 312 from said one or more LEDs 310, and said light emitting end 342 can terminate in said one or more display pins 302.

In one embodiment, said display 108 can comprise an image being oriented in an upward direction relative to gravity; wherein, said device application 340 can recalculate and display information based on an orientation of said range finder assembly 100.

Figure 4:
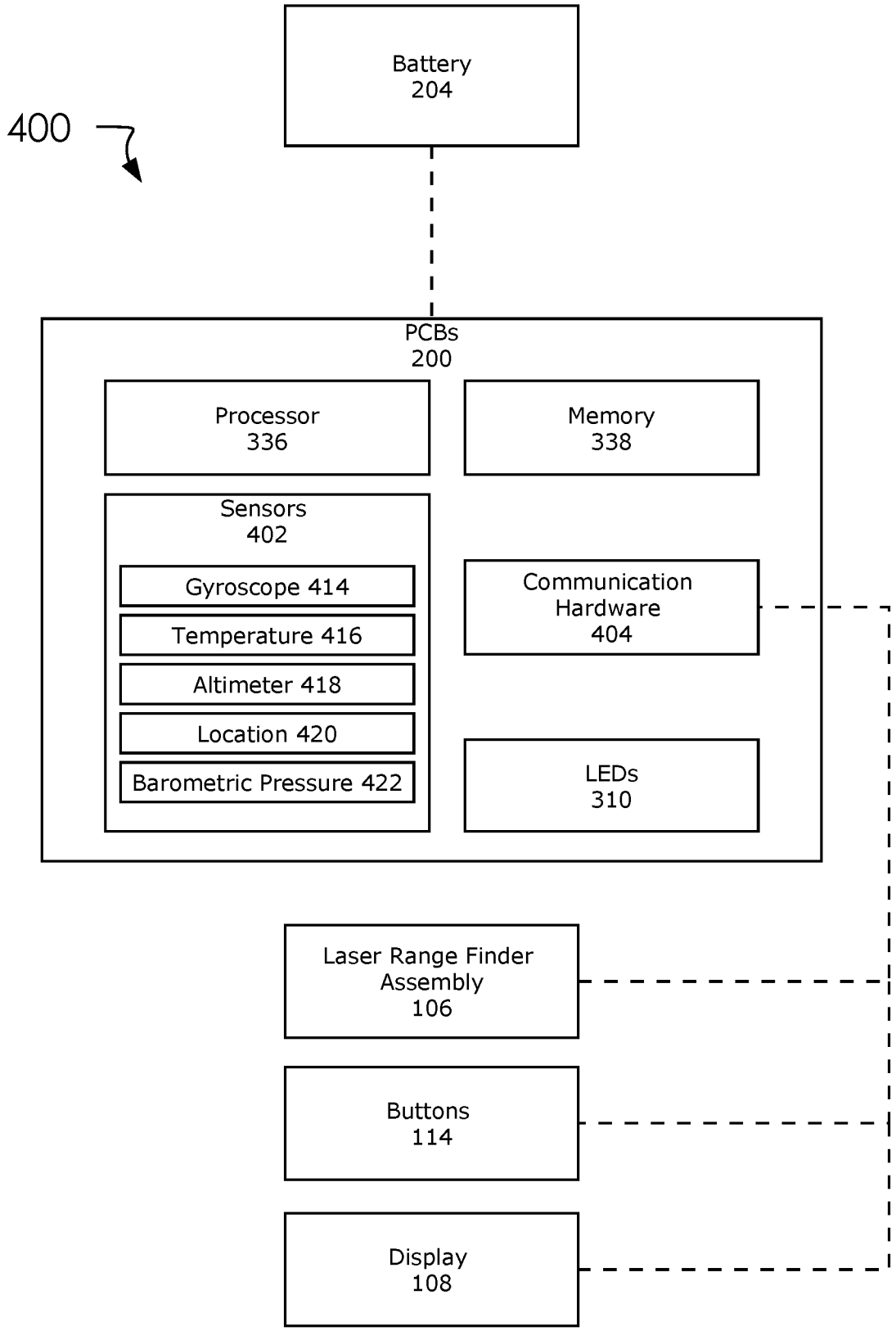
FIG. 4 illustrates a block diagram of system hardware 400 associated with said range finder assembly 100.

FIG. 4 illustrates a block diagram of system hardware 400 associated with said range finder assembly 100.

In one embodiment, said system hardware 400 can comprise said one or more processors 336, said memory 338, one or more sensors 402, a communication hardware 404, said one or more LEDs 310, and said power supply 204.

In one embodiment, said communication hardware 404 can communicate with said range finder assembly 106, said display 108, and said one or more button jacks 114.

Said power supply 204 can comprise a LIPO battery, rechargeable, disposable battery, or similar, as is known in the art.

Said one or more sensors 402 can comprise a gyroscope 414 to provide an orientation of said range finder assembly 100, one or more temperature sensors 416, an altimeters 418, a location sensor 420, a barometric pressure sensors 422, and similar for assessing the conditions surrounding said range finder assembly 100. In one embodiment, said gyroscope 414 can comprise a 9-axis (position) detection sensor.

In one embodiment, said display 108 can display a range from said range finder assembly 100 to a target as measured by said range finder assembly 106.

Figure 5A:
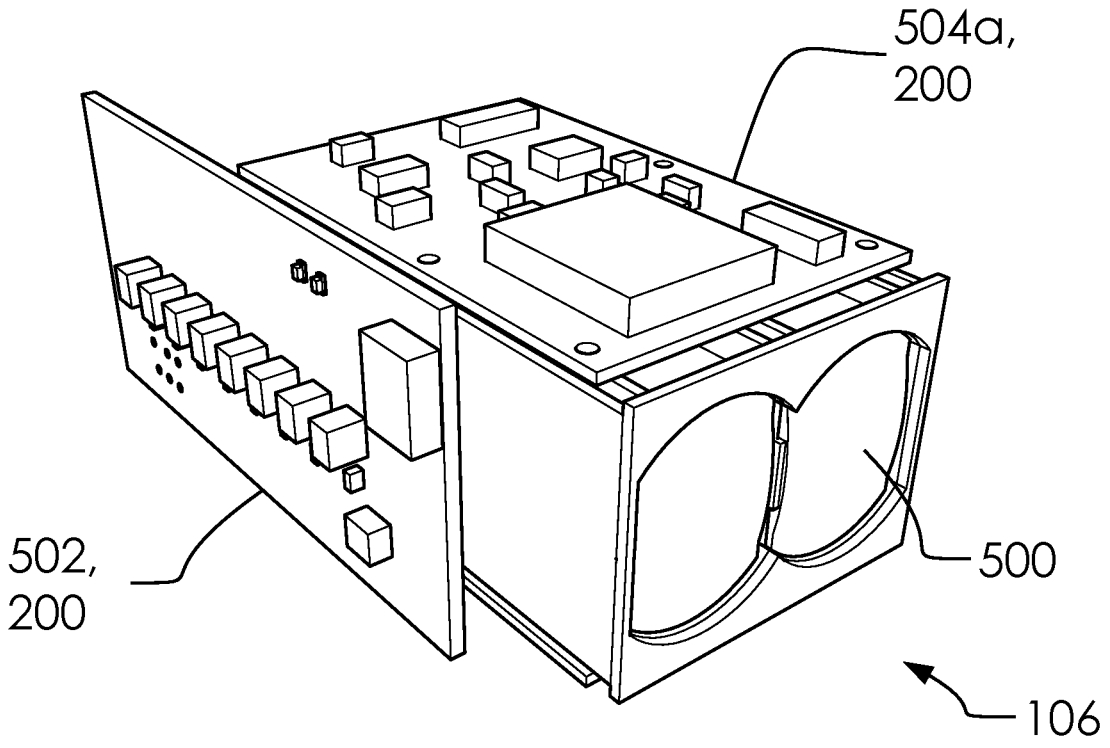
FIGS. 5A and 5B illustrate a perspective overview and lower view of said range finder assembly 106 with said one or more PCBs 200.
Figure 5B:
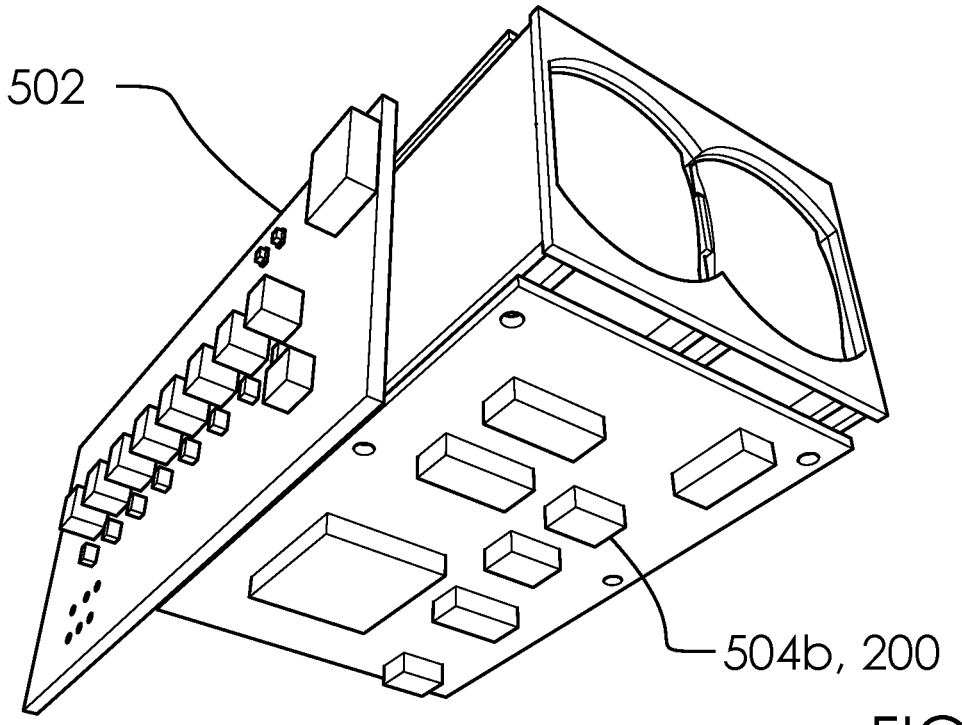

FIGS. 5A and 5B illustrate a perspective overview and lower view of said range finder assembly 106 with said one or more PCBs 200.

In one embodiment, said range finder assembly 106 can comprise one or more laser emitters 500 for range detection. In one embodiment, said one or more laser emitters 500 can comprise Class I or II.

In one embodiment, a portion of said one or more PCBs 200 can function as a controller for said range finder assembly 106. In one embodiment, said range finder assembly 106 can communicate with said device application 340 by sending said range signal 324 as a data packet.

In one embodiment, said one or more PCBs 200 can comprise a primary PCB 502, a first range finder PCB 504*a* and a second range finder PCB 504*b*.

Said one or more LEDs 310 being integrated directly into said one or more PCBs 200, as illustrated.

Figure 6:
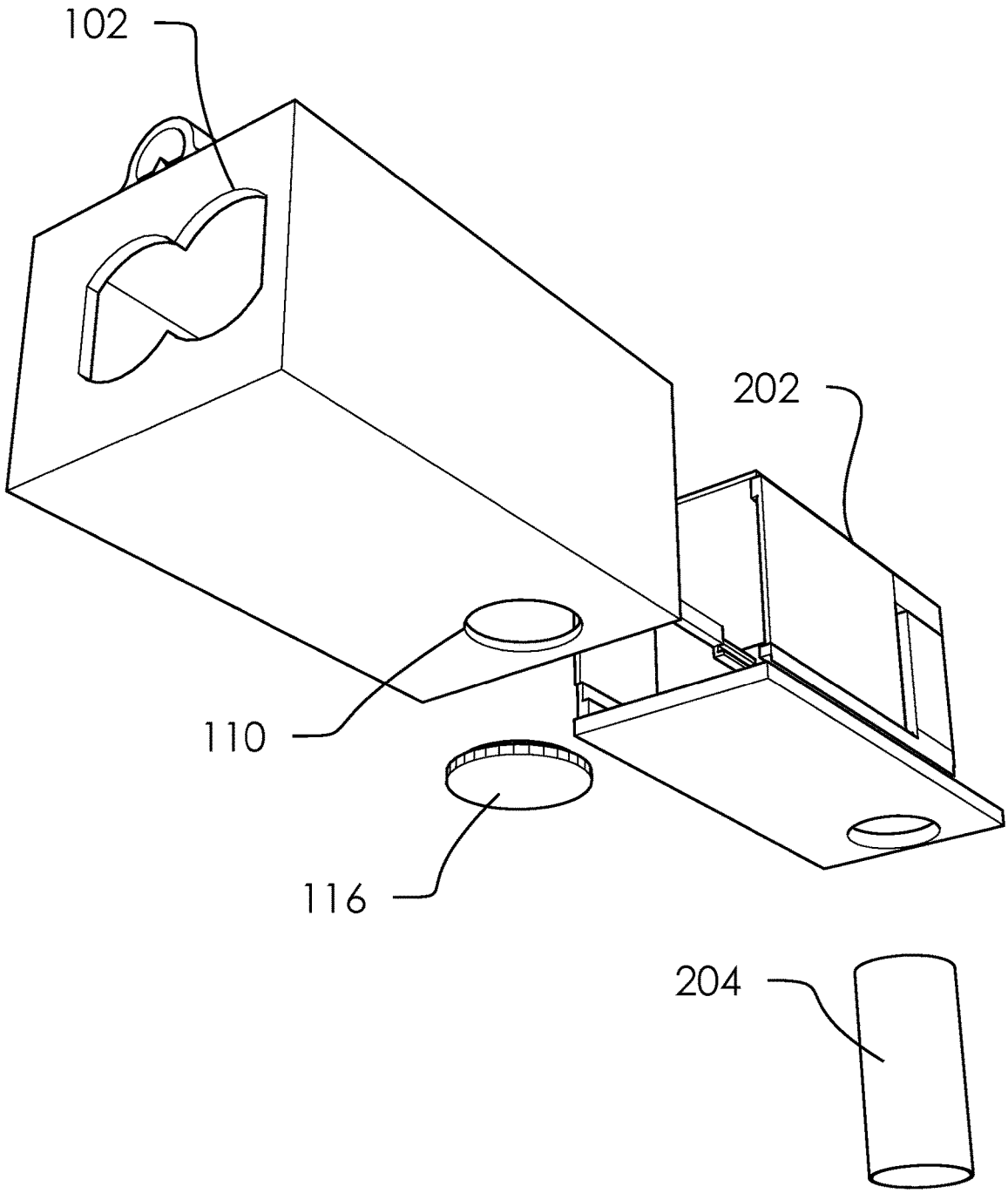
FIG. 6 illustrates an exploded perspective overview of a housing 102, a mounting bracket 202, and a power supply 204.

FIG. 6 illustrates an exploded perspective overview of said housing 102, said mounting bracket 202, and said power supply 204.

In one embodiment, said battery compartment 110 can comprise said battery door 116 in a portion of 134, and a controller assembly behind said battery door 116.

Figure 7A:
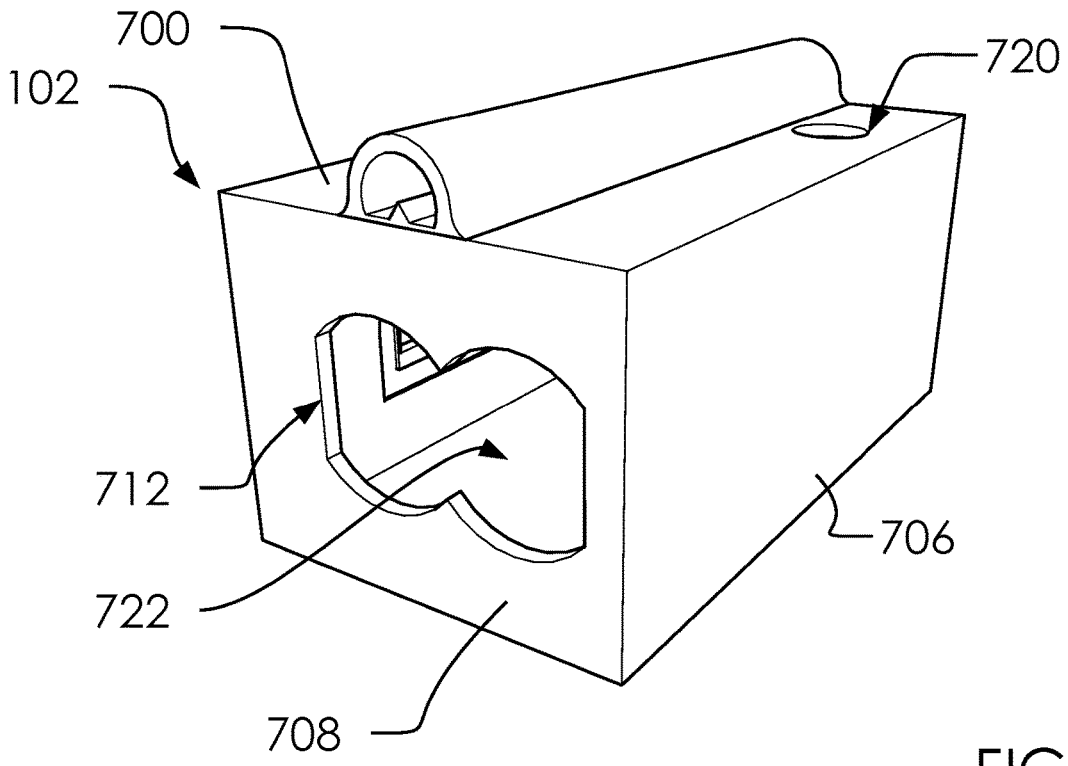
FIGS. 7A and 7B illustrate a perspective overview and perspective lower view of said housing 102.
Figure 7B:
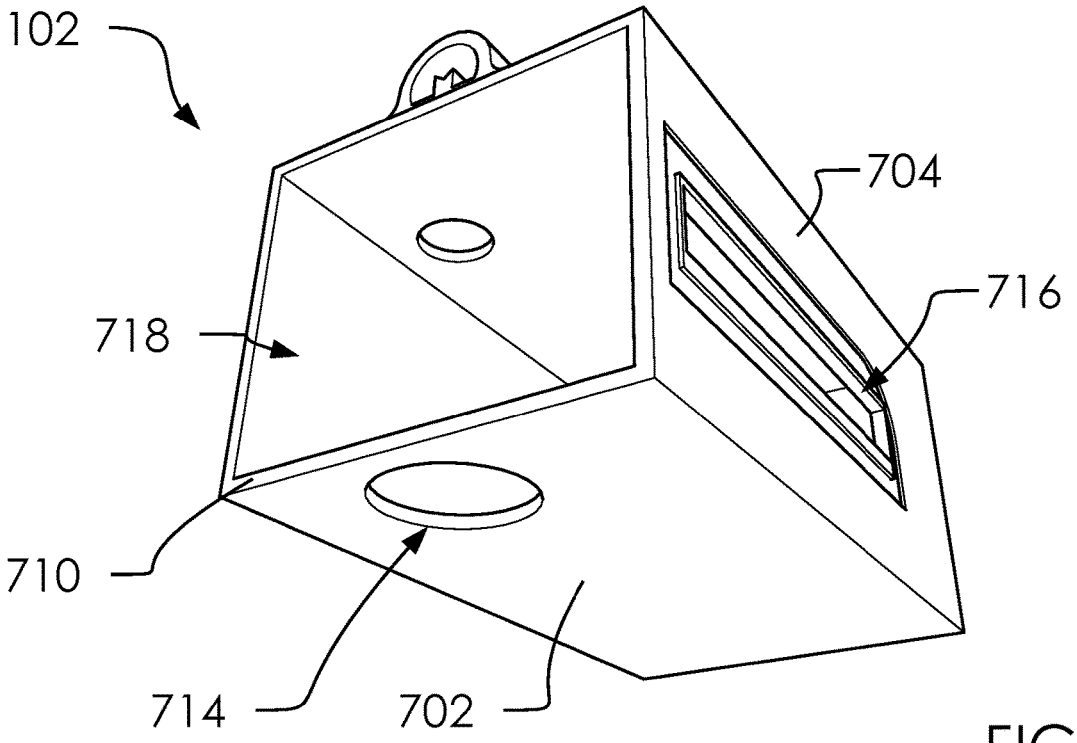

FIGS. 7A and 7B illustrate a perspective overview and perspective lower view of said housing 102.

Said housing 102 can comprise a top 700, a bottom 702, a first side 704, a second side 706, a first end 708 and a second end 710. In one embodiment, said housing 102 can comprise a laser aperture 712, a battery compartment aperture 714, a coupler aperture 716, a button aperture 720 and a display aperture 718. In one embodiment, said button aperture 720 is in said top 700, said laser aperture 712 is in said first end 708, said battery compartment aperture 714 is in said bottom 702, and said coupler aperture 716 is in said first side 704.

With said range finder assembly 100 in a fully assembled configuration, said housing 102 can be substantially watertight to protect portions of said range finder assembly 100 within said housing 102.

In one embodiment, said housing 102 can comprise a housing cavity 722 comprising a interior space within said top 700, said bottom 702, said first side 704, said second side 706, said first end 708, and said second end 710.

Figure 8:
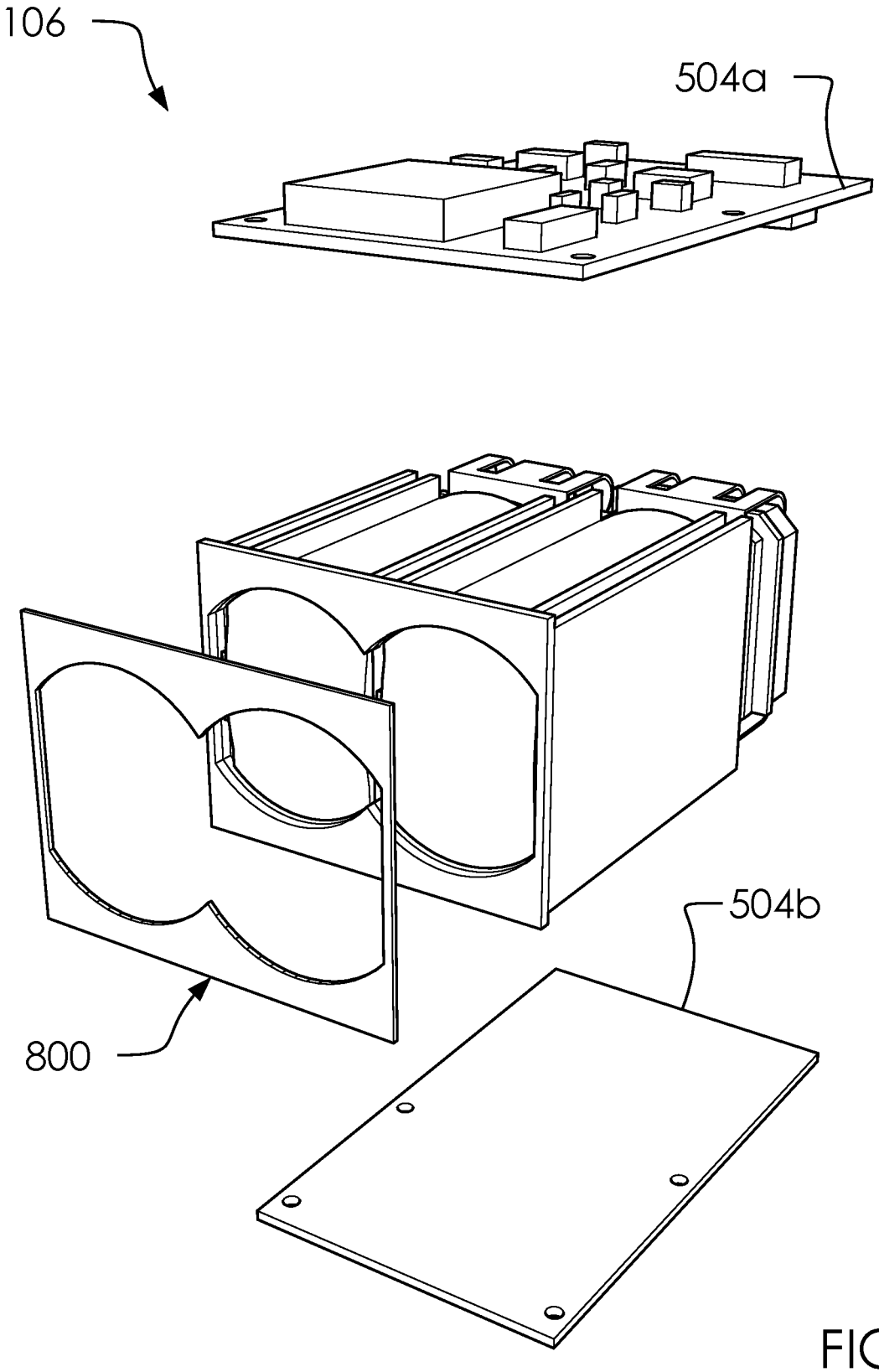
FIG. 8 illustrates a perspective overview of said range finder assembly 106 and a laser gasket 800.

FIG. 8 illustrates a perspective overview of said range finder assembly 106 and a laser gasket 800.

In one embodiment, said laser gasket 800 can be pressed between a portion of said range finder assembly 106, and said first end 708 at said laser aperture 712; wherein, a substantially watertight seal can be formed between said first end 708 and said range finder assembly 106.

Figure 9A:
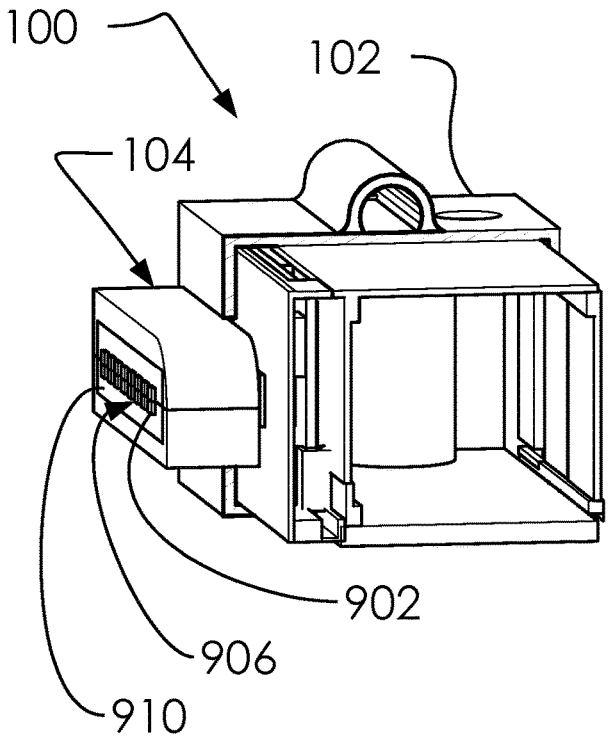
FIGS. 9A, 9B and 9C illustrate two perspective overviews and an elevated side view of said range finder assembly 100 and a cross-section of said housing 102.
Figure 9B:
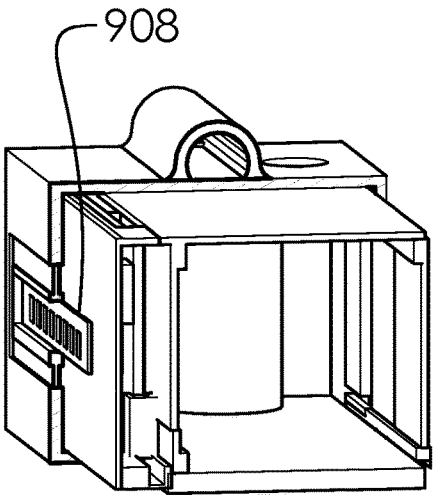
Figure 9C:
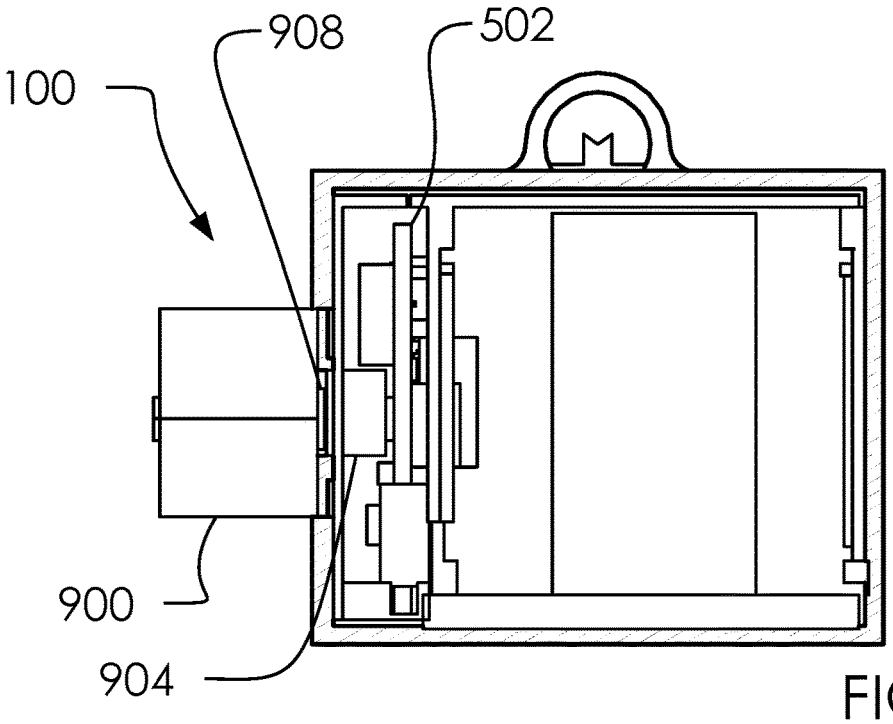

FIGS. 9A, 9B and 9C illustrate two perspective overviews and an elevated side view of said range finder assembly 100 and a cross-section of said housing 102.

In one embodiment, said optical coupling assembly 104 can comprise a lead receiver assembly 900, a plurality of optical line holders 902, an LED surround 904, a housing clip plate 908 and lead receiver squeeze assembly 910. Said lead receiver assembly 900 can comprise a plurality of lead receiver apertures 906.

In one embodiment, said LED surround 904 is configured to wrap around a portion of said one or more LEDs 310 and direct said light signals 312 into a portion of said lead receiver assembly 900. Said plurality of optical line holders 902 can be configured to selectively fill a portion of said plurality of lead receiver apertures 906.

In one embodiment, said lead receiver assembly 900 can extend outside of said housing 102. Said housing 102 can comprise a lead receiver aperture configured to allow a portion of said optical coupling assembly 104 to selectively connect to said one or more LEDs 310, which can be within said housing 102. In one embodiment, said plurality of lead receiver apertures 906 can be configured for receiving said one or more sight pin leads 316 and shine light into said light receiver end 344 of said one or more sight pin leads 316 using said one or more LEDs 310.

In one embodiment, said housing clip plate 908 can selectively clip into said coupler aperture 716 of said housing 102. One purpose of said housing clip plate 908 attached to said coupler aperture 716 can be to seal off said housing cavity 722. Likewise, with said lead receiver assembly 900 attached to said primary PCB 502, said housing clip plate 908 can put 1.5 mm of compression against said LED surround 904 and said lead receiver squeeze assembly 910. In one embodiment, with said housing clip plate 908 inserted into said coupler aperture 716 of said housing 102, said housing clip plate 908 can remain securely attached to said housing 102.

Figure 10A:
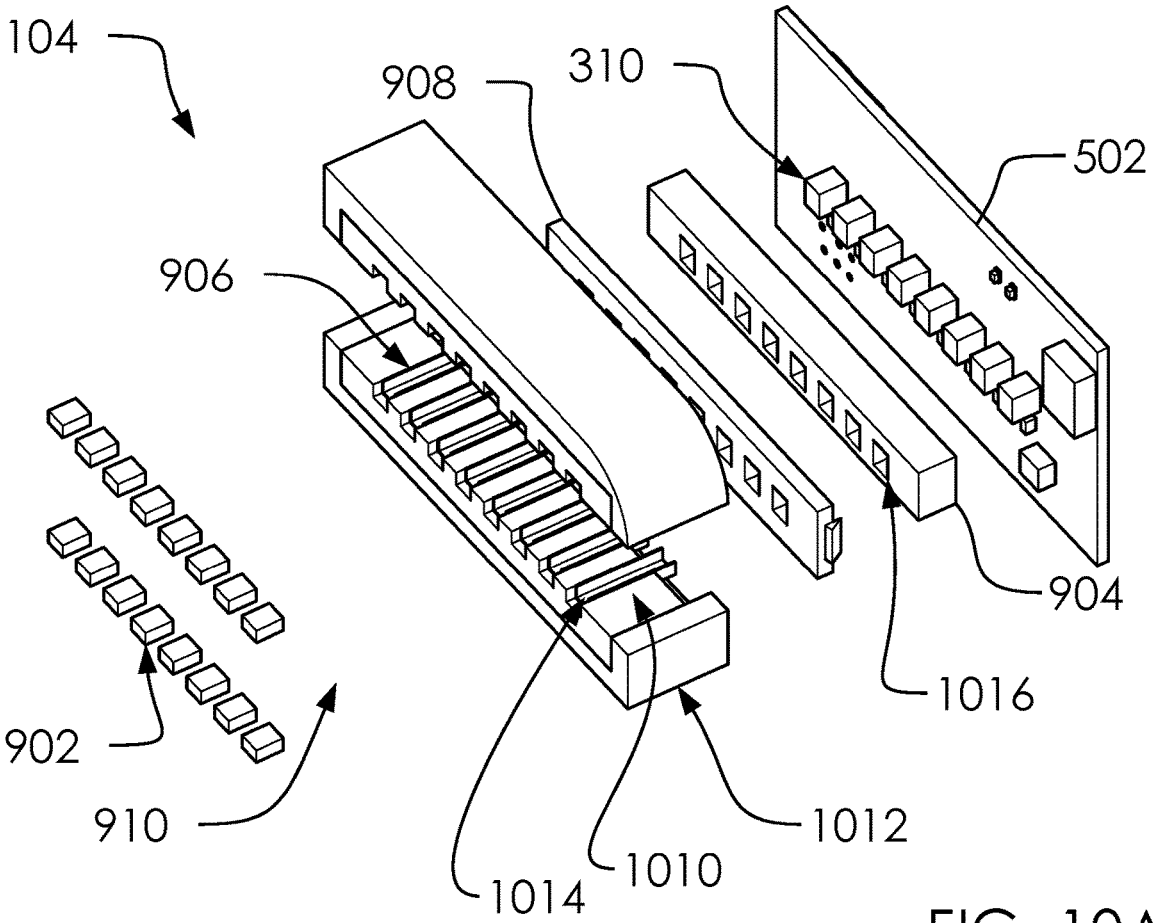
FIGS. 10A and 10B illustrate a first and second exploded perspective overview of an optical coupling assembly 104 and a primary PCB 502.
Figure 10B:
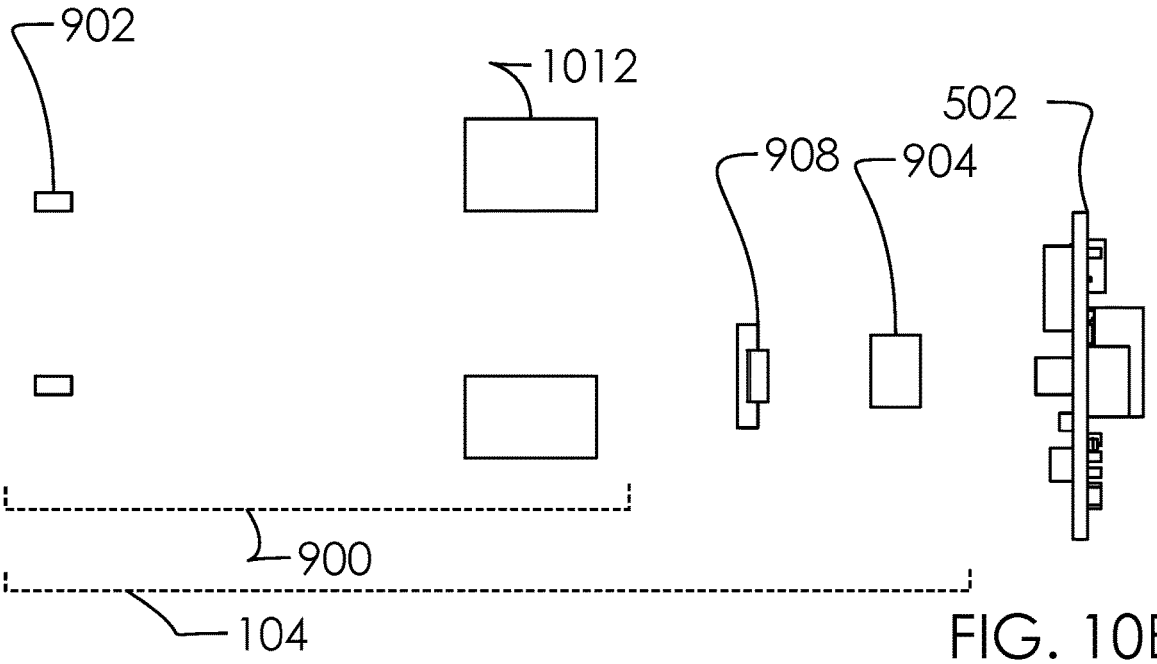

FIGS. 10A and 10B illustrate a first and second exploded perspective overview of said optical coupling assembly 104 and said primary PCB 502.

In one embodiment, said LED surround 904 can comprise a plurality of LED apertures 1016 configured to fit around each among said one or more LEDs 310.

In one embodiment, said optical coupling assembly 104 can comprise a set of components configured to attach said one or more sight pin leads 316 to said one or more LEDs 310. In one embodiment, said optical coupling assembly 104 can comprise said lead receiver assembly 900, said plurality of optical line holders 902, and said LED surround 904. In one embodiment, said lead receiver assembly 900 can comprise said lead receiver squeeze assembly 910, a plurality of lead tunnels 1010, and a lead receiver bezel 1012.

In one embodiment, each part among said lead receiver assembly 900 can be sliced into to portions at approximately half its height. Wherein, each can be pressed back together to enclose a portion of said light receiver end 344 of said one or more sight pin leads 316. In one embodiment, each among said plurality of lead tunnels 1010 can comprise a light cavity 1014 wherein said light receiver end 344 and light from said one or more LEDs 310 can share a space to send said light into said one or more sight pin leads 316. In one embodiment, said lead receiver bezel 1012 can be attached around portions of said lead receiver squeeze assembly 910 and said plurality of lead tunnels 1010 to hold together said lead receiver assembly 900. In one embodiment, each part of said lead receiver bezel 1012 can be attached to one another with screws, glue, or other fasteners.

In one embodiment, said optical coupling assembly 104 can comprise said plurality of optical line holders 902, said plurality of lead tunnels 1010, and said LED surround 904. In one embodiment, said one or more LEDs 310 can be integrated into said primary PCB 502; said plurality of LED apertures 1016 in said LED surround 904 can connect to said one or more LEDs 310 on one side and said plurality of lead tunnels 1010 on another side; said plurality of lead tunnels 1010 can connect to said LED surround 904 on one side and said plurality of optical line holders 902 on another side; said plurality of lead tunnels 1010 can comprise said light cavity 1014 for coupling said light receiver end 344 with said one or more LEDs 310; and said plurality of optical line holders 902 can enclose said plurality of lead tunnels 1010 to ensure light from one among said one or more LEDs 310 does not pollute another.

Figure 11A:
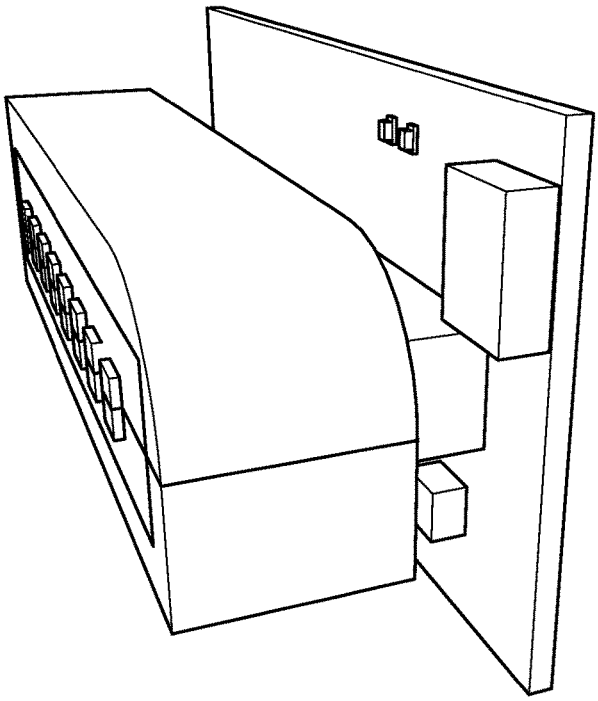
FIGS. 11A and 11B illustrate a perspective overview in an assembled and disassembled configuration of said primary PCB 502 with a lead receiver assembly 900.
Figure 11B:
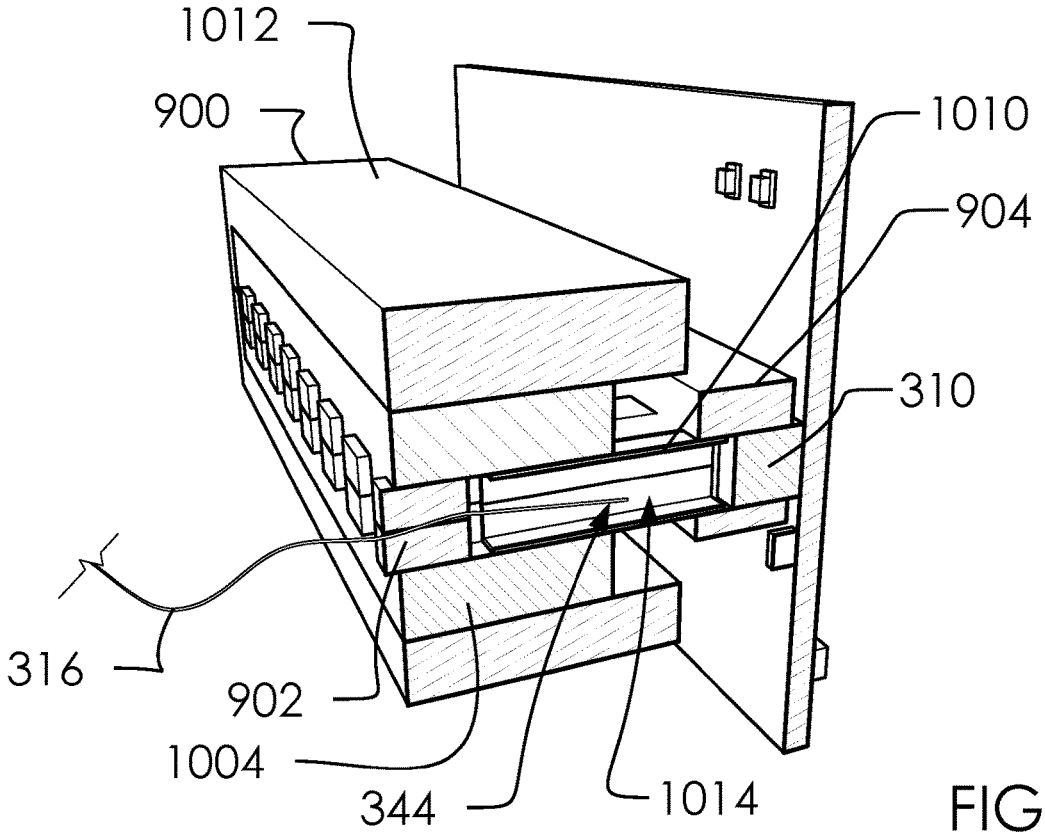

FIGS. 11A and 11B illustrate a perspective overview in an assembled and disassembled configuration of said primary PCB 502 with said lead receiver assembly 900.

Said LED surround 904 can be configured to slide around a portion of said one or more LEDs 310 and hold a portion of said one or more LEDs 310 at one end and a portion of said plurality of lead tunnels 1010 at another end.

In one embodiment, said LED surround 904 and said lead receiver squeeze assembly 910 can comprise a neoprene, rubber, or similar material. Accordingly, said LED surround 904 can snuggly fit around said plurality of lead tunnels 1010 and said one or more LEDs 310; and said lead receiver squeeze assembly 910 can snuggly fit around said plurality of optical line holders 902 and said plurality of lead tunnels 1010.

In one embodiment, said lead receiver assembly 900 is configured for receiving and holding said light receiver end 344 of said one or more sight pin leads 316 in alignment with one among said one or more LEDs 310.

Figure 12:
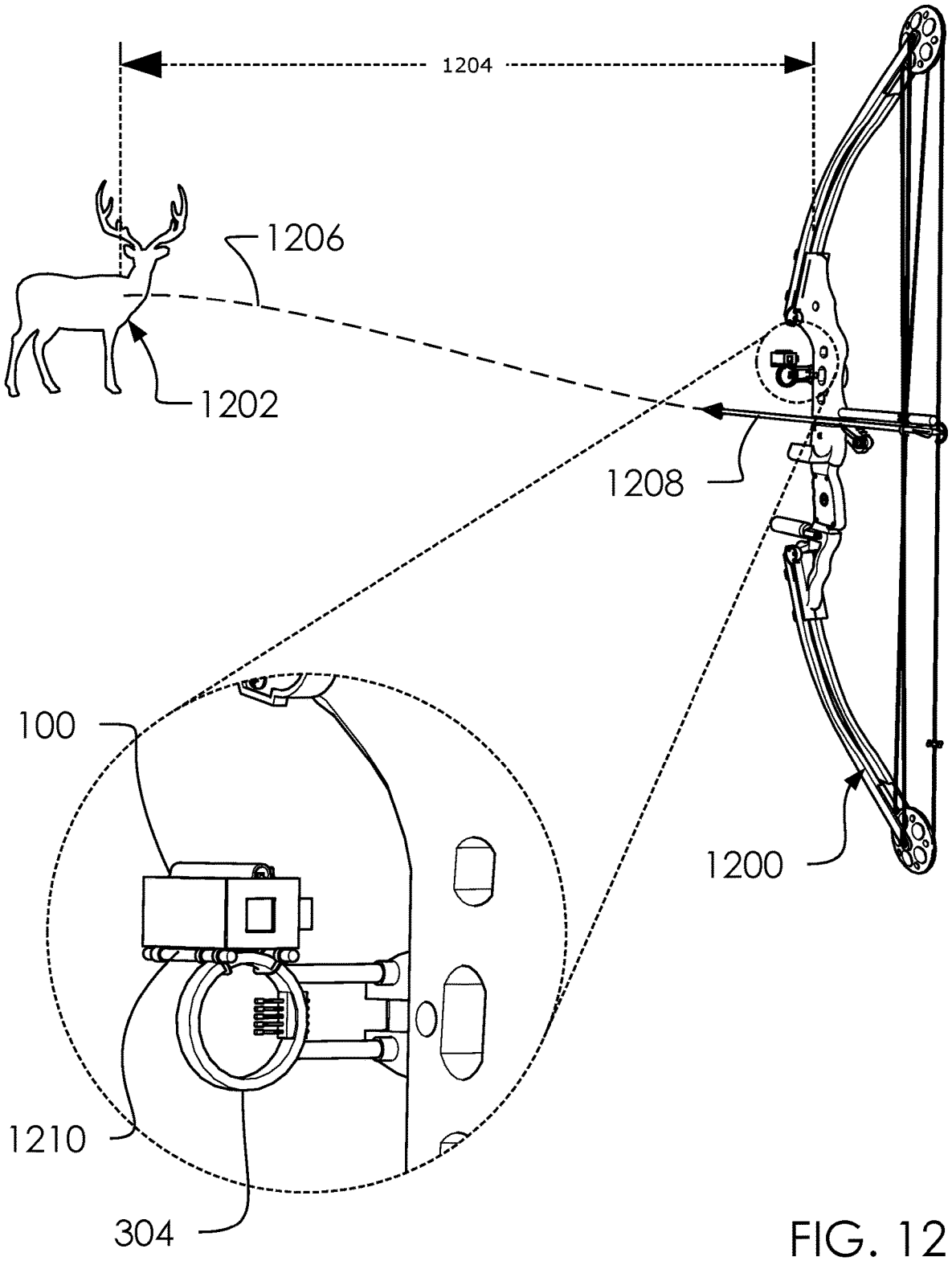
FIG. 12 illustrates said range finder assembly 100 installed on a bow 1200 and aimed at a target 1202.

FIG. 12 illustrates said range finder assembly 100 installed on a bow 1200 and aimed at a target 1202.

As shown, said target 1202 is at a target distance 1204 from said bow 1200. One objective of said range finder assembly 100 is to calculate a ballistic path 1206 of an arrow 1208 when fired from said bow 1200.

In one embodiment, said range finder assembly 100 can be attached to a portion of said bow 1200. Accessory brackets are common in the art. For illustrative purposes here, said range finder assembly 100 is attached to a mounting bracket 1210 configured to attach said range finder assembly 100 to an upper portion of said sight bracket 304.

Figure 13:
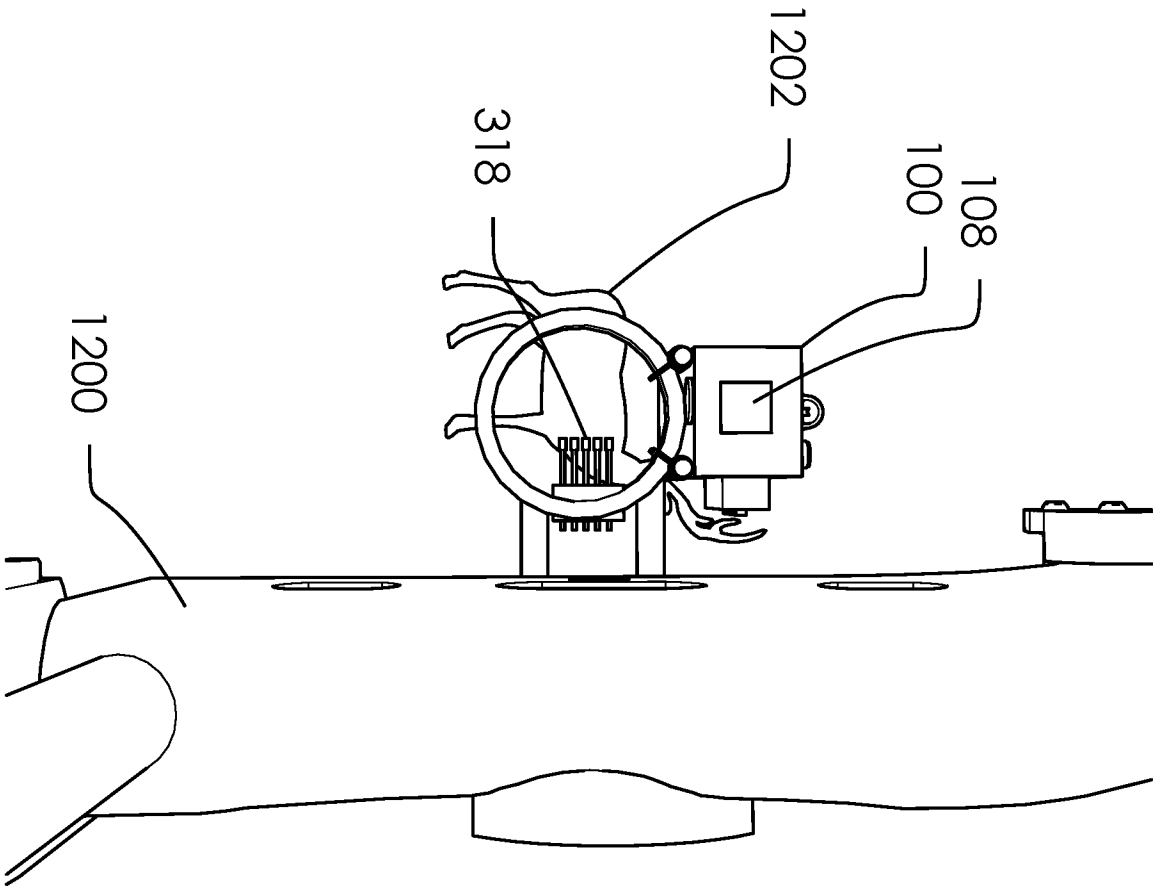
FIG. 13 illustrates said range finder assembly 100 and said bow 1200 aiming at said target 1202.

FIG. 13 illustrates said range finder assembly 100 and said bow 1200 aiming at said target 1202.

In one embodiment, said range finder assembly 100 is configured to be attached onto or near said bow sight 300 so that a user can read said display 108 and said one or more illuminated pins 318 without altering the direction of their sightline.

In one embodiment, said alignment scope 118 can be used to align said range finder assembly 100 with respect to said bow sight aiming point 330. While installing said range finder assembly 100 onto said bow sight 300 a user may use said alignment scope 118 to ensure said range finder assembly 100 is fully aligned with said bow sight aiming point 330.

Figure 14:
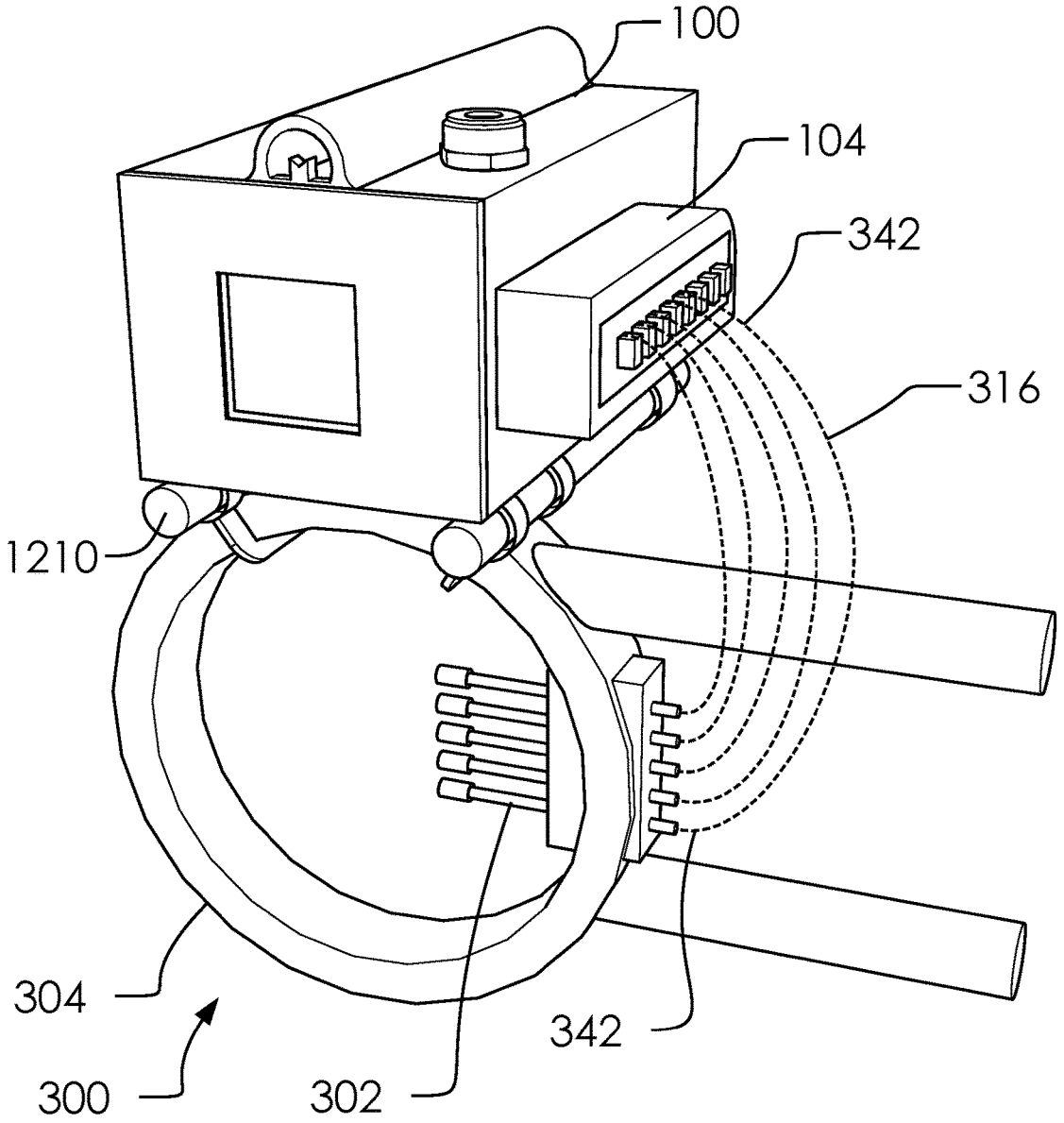
FIG. 14 illustrates perspective overview of said range finder assembly 100 and said bow sight 300 with one or more sight pin leads 316 connected between said optical coupling assembly 104 and one or more display pins 302.

FIG. 14 illustrates perspective overview of said range finder assembly 100 and said bow sight 300 with said one or more sight pin leads 316 connected between said optical coupling assembly 104 and said one or more display pins 302.

As shown, said one or more sight pin leads 316 can be connected between said optical coupling assembly 104 at said light receiver end 344 and said one or more display pins 302 at said light emitting end 342.

Figures 15A, 15B:
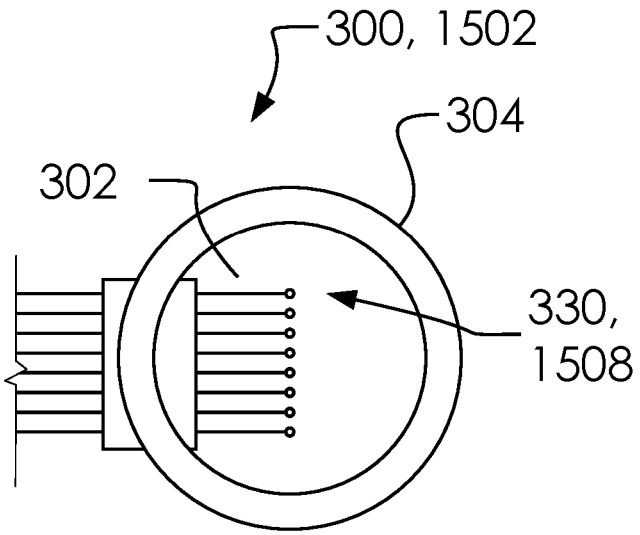
FIGS. 15A and 15B illustrate a pin range chart 1500 and an eight-pin sight 1502.

FIGS. 15A and 15B illustrate a pin range chart 1500 and an eight-pin sight 1502.

In one embodiment, said bow sight 300 can comprise eight pins, as illustrated by said eight-pin sight 1502.

One feature of said range finder assembly 100 can comprise the arrangement of said one or more display pins 302 according to a plurality of desired ranges. Accordingly, said device application 340 can comprise values associated with each among said one or more display pins 302, namely, a pin number 1506 for identification and a pin range 1504 setting out a calibrated range when aiming at said target 1202 through said bow sight 300.

The values listed as said pin range 1504 are exemplary and may be quite different in a real-world application, as is known in the art. However, for this example, a first pin 1508 when aligned as said bow sight aiming point 330 is calibrated to ensure said arrow 1208 travels 10 yards consistently.

In one embodiment, said memory 338 can comprise said device application 340, said pin range chart 1500 and a signal and range tolerance table 1510. Said pin range chart 1500 can comprise values related to each pin, such as said pin number 1506 and said first pin 1508, as noted above. Said signal and range tolerance table 1510 comprising signals to display on said one or more display pins 302 for various events, as noted below.

Said signal and range tolerance table 1510 can comprise a table comprising a signal number 1512, a tolerance range 1514, and a display action 1516.

Figure 16:
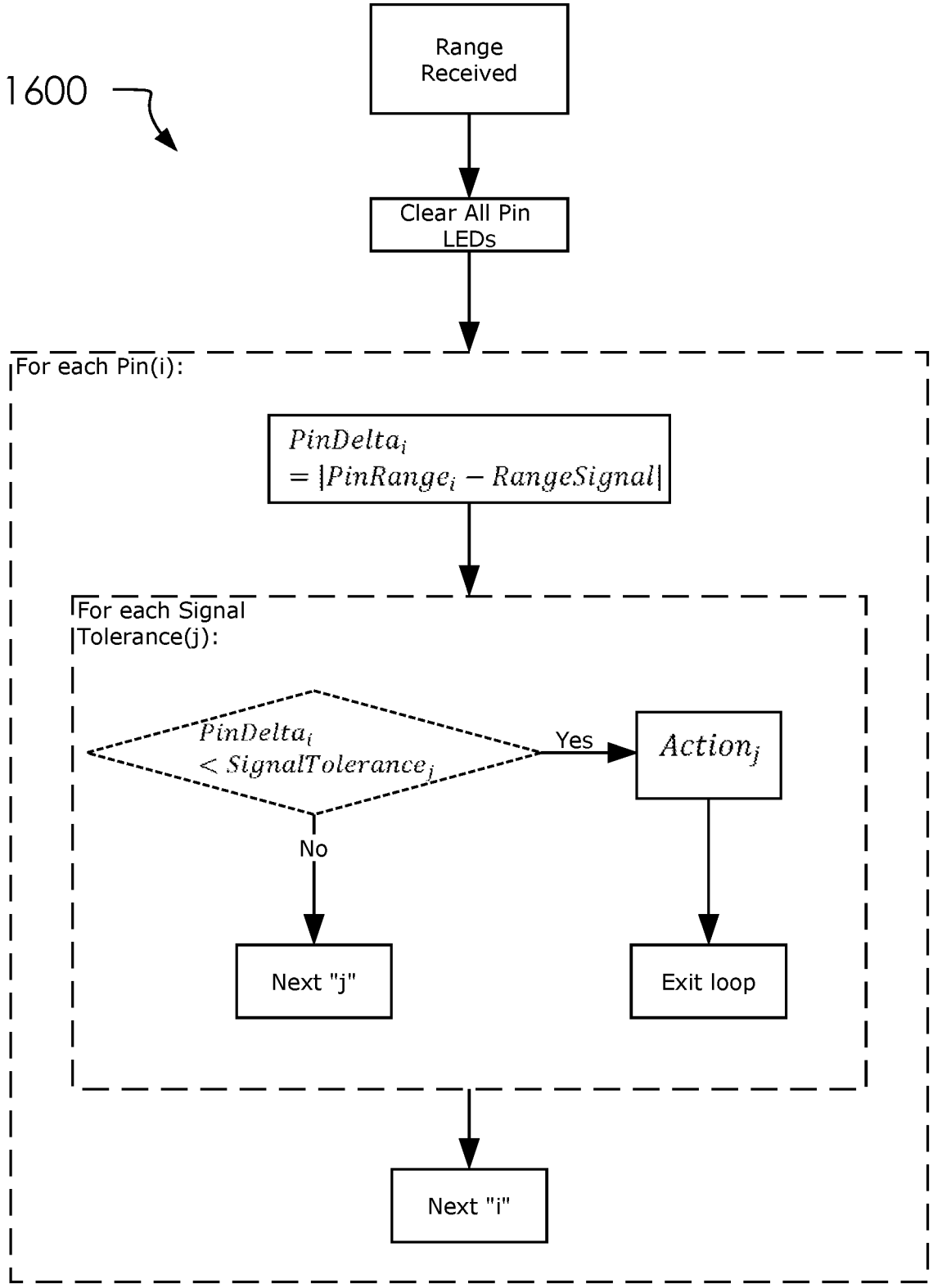
FIG. 16 illustrates a pin lighting algorithm 1600 as a flow chart.

FIG. 16 illustrates a pin lighting algorithm 1600 as a flow chart.

In one embodiment, said device application 340 can comprise said pin lighting algorithm 1600 for calculating said range display signal 328.

In one embodiment, said pin lighting algorithm 1600 can comprise: receiving said range signal 324 from said range finder assembly 106, clearing each said one or more display pins 302, calculating—for each pin—a pin range delta 1604 between said range signal 324 and said pin range 1504, comparing said pin range delta 1604 with values in said signal and range tolerance table 1510 to determine which among said display action 1516 to enact for each among said one or more display pins 302.

FIGS. 17A, 17B and 17C illustrate said pin range chart 1500, said signal and range tolerance table 1510 and an example range display signal table 1700.

Said example range display signal table 1700 comprises an example range value 1702 and a plurality of pin signals 1704. Said plurality of pin signals 1704 comprises a first pin signal 1704*a*, a second pin signal 1704*b*, a third pin signal 1704*c*, a fourth pin signal 1704*d*, a fifth pin signal 1704*e*, a sixth pin signal 1704*f*, a seventh pin signal 1704*g*, and an eighth pin signal 1704*h*.

FIGS. 18A, 18B and 18C illustrate said pin range chart 1500, said signal and range tolerance table 1510 and an example range display signal table 1800.

In both cases, said example range display signal table 1700 and said example range display signal table 1800, represent the application of said pin lighting algorithm 1600 to said example range value 1702 considering variations on said signal and range tolerance table 1510. Both are presented as examples of the application of said pin lighting algorithm 1600, and do not represent limits in variations on said display action 1516 or said pin range 1504, as would be obvious to one in the art.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

PARTS LIST said range finder assembly 100,
Said housing 102,
Said optical coupling assembly 104,
Said range finder assembly 106,
Said display 108,
Said one or more button jacks 114,
Said battery compartment 110,
Said battery door 116,
Said alignment scope 118,
Said display bezel 112,
Said one or more PCBs 200,
Said mounting bracket 202,
Said power supply 204,
Said bow sight 300,
Said one or more display pins 302,
Said sight bracket 304,
Said one or more LEDs 310,
Said one or more sight pin leads 316,
Said light receiver end 344,
Said light emitting end 342,
Said light signals 312,
Said one or more illuminated pins 318,
Said range signal 324,
Said address space 334,
Said one or more processors 336,
Said memory 338,
Said device application 340,
Said range display signal 328,
Said bow sight aiming point 330,
Said system hardware 400,
Said one or more sensors 402,
Said communication hardware 404,
Said gyroscope 414,
Said one or more temperature sensors 416,
Said altimeters 418,
Said location sensor 420,
Said barometric pressure sensors 422,
Said one or more laser emitters 500,
Said primary PCB 502,
Said first range finder PCB 504*a*,
Said second range finder PCB 504*b*,
Said top 700,
Said bottom 702,
Said first side 704,
Said second side 706,
Said first end 708,
Said second end 710,
Said laser aperture 712,
Said battery compartment aperture 714,
Said coupler aperture 716,
Said button aperture 720,
Said display aperture 718,
Said housing cavity 722,
Said laser gasket 800,
Said lead receiver assembly 900,
Said plurality of optical line holders 902,
Said LED surround 904, Said housing clip plate 908,
Said lead receiver squeeze assembly 910,
Said plurality of lead receiver apertures 906,
Said plurality of LED apertures 1016,
Said plurality of lead tunnels 1010,
Said lead receiver bezel 1012,
Said light cavity 1014,
Said bow 1200,
Said target 1202,
Said target distance 1204,
Said ballistic path 1206,
Said arrow 1208,
Said mounting bracket 1210,
Said pin range chart 1500,
Said eight-pin sight 1502,
Said pin number 1506,
Said pin range 1504,
Said first pin 1508,
Said signal and range tolerance table 1510,
Said signal number 1512,
Said tolerance range 1514,
Said display action 1516,
Said pin lighting algorithm 1600,
Said pin range delta 1604,
Said example range display signal table 1700,
Said example range value 1702,
Said plurality of pin signals 1704,
Said first pin signal 1704*a*,
Said second pin signal 1704*b*,
Said third pin signal 1704*c*,
Said fourth pin signal 1704*d*,
Said fifth pin signal 1704*e*,
Said sixth pin signal 1704*f*,
Said seventh pin signal 1704*g*,
Said eighth pin signal 1704*h*, and
said example range display signal table 1800.

The following summary of the original claims are included and represent a preferred embodiment of said range finder assembly 100.

Said range finder assembly 100 for coupling said one or more display pins 302 with said one or more LEDs 310, measuring a distance to said target 1202 and displaying said range display signal 328 on said one or more display pins 302 can comprise said range finder assembly 100 comprising said one or more sight pin leads 316 having said light emitting end 342 and said light receiver end 344, said one or more PCBs 200, said range finder assembly 106, said one or more LEDs 310, said power supply 204, said device application 340 and said optical coupling assembly 104. Said one or more PCBs 200 comprises said one or more processors 336 and said memory 338. Said one or more processors 336 can be configured for executing said device application 340. Said device application 340 can be configured for interpreting said range signal 324 from said range finder assembly 106 and generating said range display signal 328. Said one or more LEDs 310 generate said light signals 312. Said one or more LEDs 310 can be selectively routed into said light receiver end 344 of said one or more sight pin leads 316 using said optical coupling assembly 104. Said light emitting end 342 connect to said one or more display pins 302 within said bow sight 300. each among said one or more display pins 302 correspond to said bow sight aiming point 330 of said bow sight 300. Said device application 340 can be configured to associate each among said one or more display pins 302 and said one or more LEDs 310 with said pin number 1506 and said pin range 1504. Said range finder assembly 100 can be configured to communicate a summary of said range signal 324 to said bow sight 300 by sending said range display signal 328 to said one or more LEDs 310, displaying said range display signal 328 using said light signals 312 on said one or more LEDs 310, routing said light signals 312 into said light receiver end 344 of said one or more sight pin leads 316 using said optical coupling assembly 104, and displaying said range display signal 328 on said one or more display pins 302. Said LED surround 904 can be configured to slide around a portion of said one or more LEDs 310 and hold a portion of said one or more LEDs 310 at one end and a portion of said plurality of lead tunnels 1010 at another end. Said LED surround 904 and said lead receiver squeeze assembly 910 comprises a material selected among neoprene and rubber. Said LED surround 904 snuggly fitting around said plurality of lead tunnels 1010 and said one or more LEDs 310. Said lead receiver squeeze assembly 910 can snuggly fit around said plurality of optical line holders 902 and said plurality of lead tunnels 1010. Said lead receiver assembly 900 can be configured for receiving and holding said light receiver end 344 of said one or more sight pin leads 316 in alignment with one among said one or more LEDs 310.

Said range finder assembly 100 for coupling said one or more display pins 302 with said one or more LEDs 310, measuring a distance to said target 1202 and displaying said range display signal 328 on said one or more display pins 302 can comprise said range finder assembly 100 comprising said one or more sight pin leads 316 having said light emitting end 342 and said light receiver end 344, said one or more PCBs 200, said range finder assembly 106, said one or more LEDs 310, said power supply 204, said device application 340 and said optical coupling assembly 104. Said one or more PCBs 200 comprises said one or more processors 336 and said memory 338. Said one or more processors 336 can be configured for executing said device application 340. Said device application 340 can be configured for interpreting said range signal 324 from said range finder assembly 106 and generating said range display signal 328. Said one or more LEDs 310 generate said light signals 312. Said one or more LEDs 310 can be selectively routed into said light receiver end 344 of said one or more sight pin leads 316 using said optical coupling assembly 104. Said light emitting end 342 connect to said one or more display pins 302 within said bow sight 300. each among said one or more display pins 302 correspond to said bow sight aiming point 330 of said bow sight 300. Said device application 340 can be configured to associate each among said one or more display pins 302 and said one or more LEDs 310 with said pin number 1506 and said pin range 1504. Said range finder assembly 100 can be configured to communicate a summary of said range signal 324 to said bow sight 300 by sending said range display signal 328 to said one or more LEDs 310, displaying said range display signal 328 using said light signals 312 on said one or more LEDs 310, routing said light signals 312 into said light receiver end 344 of said one or more sight pin leads 316 using said optical coupling assembly 104, and displaying said range display signal 328 on said one or more display pins 302. Said LED surround 904 can be configured to slide around a portion of said one or more LEDs 310 and hold a portion of said one or more LEDs 310 at one end and a portion of said plurality of lead tunnels 1010 at another end. Said LED surround 904 and said lead receiver squeeze assembly 910 comprises a material selected among neoprene and rubber. Said LED surround 904 snuggly fitting around said plurality of lead tunnels 1010 and said one or more LEDs 310. Said lead receiver squeeze assembly 910 can snuggly fit around said plurality of optical line holders 902 and said plurality of lead tunnels 1010. Said lead receiver assembly 900 can be configured for receiving and holding said light receiver end 344 of said one or more sight pin leads 316 in alignment with one among said one or more LEDs 310.

Said range finder assembly 100 for coupling said one or more display pins 302 with said one or more LEDs 310, measuring a distance to said target 1202 and displaying said range display signal 328 on said one or more display pins 302 can comprise said range finder assembly 100 comprising said one or more sight pin leads 316 having said light emitting end 342 and said light receiver end 344, said one or more PCBs 200, said range finder assembly 106, said one or more LEDs 310, said power supply 204, said device application 340 and said optical coupling assembly 104. Said one or more PCBs 200 comprises said one or more processors 336 and said memory 338. Said one or more processors 336 can be configured for executing said device application 340. Said device application 340 can be configured for interpreting said range signal 324 from said range finder assembly 106 and generating said range display signal 328. Said one or more LEDs 310 generate said light signals 312. Said one or more LEDs 310 can be selectively routed into said light receiver end 344 of said one or more sight pin leads 316 using said optical coupling assembly 104. Said light emitting end 342 connect to said one or more display pins 302 within said bow sight 300. each among said one or more display pins 302 correspond to said bow sight aiming point 330 of said bow sight 300. Said device application 340 can be configured to associate each among said one or more display pins 302 and said one or more LEDs 310 with said pin number 1506 and said pin range 1504. Said range finder assembly 100 can be configured to communicate a summary of said range signal 324 to said bow sight 300 by sending said range display signal 328 to said one or more LEDs 310, displaying said range display signal 328 using said light signals 312 on said one or more LEDs 310, routing said light signals 312 into said light receiver end 344 of said one or more sight pin leads 316 using said optical coupling assembly 104, and displaying said range display signal 328 on said one or more display pins 302.

Said LED surround 904 can be configured to slide around a portion of said one or more LEDs 310 and hold a portion of said one or more LEDs 310 at one end and a portion of said plurality of lead tunnels 1010 at another end. Said LED surround 904 and said lead receiver squeeze assembly 910 comprises a material selected among neoprene and rubber. Said LED surround 904 snuggly fitting around said plurality of lead tunnels 1010 and said one or more LEDs 310. Said lead receiver squeeze assembly 910 can snuggly fit around said plurality of optical line holders 902 and said plurality of lead tunnels 1010. Said lead receiver assembly 900 can be configured for receiving and holding said light receiver end 344 of said one or more sight pin leads 316 in alignment with one among said one or more LEDs 310.

Said optical coupling assembly 104 comprises said plurality of optical line holders 902, said plurality of lead tunnels 1010, and said LED surround 904. Said one or more LEDs 310 can be integrated into said primary PCB 502. Said plurality of LED apertures 1016 in said LED surround 904 can connect to said one or more LEDs 310 on one side and said plurality of lead tunnels 1010 on another side. Said plurality of lead tunnels 1010 can connect to said LED surround 904 on one side and said plurality of optical line holders 902 on another side. Said plurality of lead tunnels 1010 comprises said light cavity 1014 for coupling said light receiver end 344 with said one or more LEDs 310. and said plurality of optical line holders 902 can enclose said plurality of lead tunnels 1010 to ensure light from one among said one or more LEDs 310 does not pollute another.

Said LED surround 904 and said lead receiver squeeze assembly 910 comprises a material selected among neoprene and rubber. Said LED surround 904 snuggly fitting around said plurality of lead tunnels 1010 and said one or more LEDs 310. Said lead receiver squeeze assembly 910 can snuggly fit around said plurality of optical line holders 902 and said plurality of lead tunnels 1010.

Said optical coupling assembly 104 comprises said lead receiver assembly 900, said plurality of optical line holders 902, and said LED surround 904. Said lead receiver assembly 900 comprises said plurality of lead receiver apertures 906. Said LED surround 904 can be configured to wrap around a portion of said one or more LEDs 310 and direct said light signals 312 into a portion of said lead receiver assembly 900. Said plurality of optical line holders 902 can be configured to selectively fill a portion of said plurality of lead receiver apertures 906. Said lead receiver assembly 900 can extend outside of said housing 102. Said housing 102 comprises a lead receiver aperture configured to allow a portion of said optical coupling assembly 104 to selectively connect to said one or more LEDs 310, which can be within said housing 102. Said plurality of lead receiver apertures 906 can be configured for receiving said one or more sight pin leads 316 and shining light into said light receiver end 344 of said one or more sight pin leads 316 using said one or more LEDs 310. Said LED surround 904 comprises said plurality of LED apertures 1016 configured to fit around each among said one or more LEDs 310.

a portion of said one or more display pins 302 being lit by said light signals 312 comprise said one or more illuminated pins 318. Said device application 340 comprises said pin lighting algorithm 1600 for calculating said range display signal 328. Said pin lighting algorithm 1600 comprises receiving said range signal 324 from said range finder assembly 106, clearing each said one or more display pins 302, calculating—for each pin—said pin range delta 1604 between said range signal 324 and said pin range 1504, and comparing said pin range delta 1604 with values in said signal and range tolerance table 1510 to determine which among said display action 1516 to enact for each among said one or more display pins 302. wherein, said display action 1516 comprises a visible signal on said one or more illuminated pins 318 among said one or more display pins 302 of said bow sight 300.

Said display action 1516 comprises a selection among variations of colored lights, solid and blinking light patterns, and variations on intensity of light.

Said range finder assembly 100 further comprises said one or more sensors 402. Said one or more sensors 402 comprise said gyroscope 414. Said device application 340 can be configured for receiving one or more gyroscope signals, and adjusting display said range display signal 328 according to a pitch of said range finder assembly 100.

Said gyroscope 414 comprises a multi-axis gyroscope.

Said range finder assembly 100 further comprises said display 108 configured to display a numerical summary of said range signal 324.

Said range display signal 328 corresponds to lighting up one or more among said one or more display pins 302 using said one or more LEDs 310 associated with said target distance 1204 to said target 1202.

Said range finder assembly 106 comprises a laser range finder.

Said range finder assembly 100 further comprises said one or more sensors 402. Said one or more sensors 402 comprise one or more selected among said gyroscope 414, said one or more temperature sensors 416, said altimeters 418, said location sensor 420, and said barometric pressure sensors 422. Said device application 340 can be configured for receiving one or more sensor signals from said one or more sensors 402 and modify said range display signal 328 according to a ballistic algorithm.

Said device application 340 can be configured for receiving one or more sensor signals selected among said one or more temperature sensors 416, said altimeters 418, said location sensor 420, and said barometric pressure sensors 422, and calculating a pressure altitude for said range finder assembly 100, and modifying said range display signal 328 according to said pressure altitude.

Said one or more LEDs 310 can be integrated into a portion of said one or more PCBs 200.

Said range finder assembly 100 further comprises an activation button configured to engage said range finder assembly 100 and said bow sight 300.

said activation button can be configured for activating all among said one or more display pins 302.

Said one or more sight pin leads 316 comprise fiber optic lines.

Said power supply 204 comprises a battery.

The invention claimed is:

1. A range finder assembly for coupling one or more display pins with one or more LEDs, measuring a distance to a target and displaying a range display signal on said one or more display pins, comprising:

said range finder assembly comprising one or more sight pin leads having a light emitting end and a light receiver end, one or more PCBs, a range finder assembly, said one or more LEDs, a power supply, a device application and an optical coupling assembly;

said one or more PCBs comprises one or more processors and a memory;

said one or more processors are configured for executing said device application;

said device application is configured for interpreting a range signal from said range finder assembly and generating said range display signal;

said one or more LEDs generate light signals;

said one or more LEDs are selectively routed into said light receiver end of said one or more sight pin leads using said optical coupling assembly;

said light emitting end connect to said one or more display pins within bow sight;

each among said one or more display pins correspond to a bow sight aiming point of said bow sight;

said device application is configured to associate each among said one or more display pins and said one or more LEDs with a pin number and a pin range;

said range finder assembly is configured to communicate a summary of said range signal to said bow sight by sending said range display signal to said one or more LEDs, displaying said range display signal using said light signals on said one or more LEDs, routing said light signals into said light receiver end of said one or more sight pin leads using said optical coupling assembly, and displaying said range display signal on said one or more display pins;

an LED surround is configured to slide around a portion of said one or more LEDs and hold a portion of said one or more LEDs at one end and a portion of a plurality of lead tunnels at another end;

said LED surround and lead receiver squeeze assembly comprises a material selected among neoprene and rubber;

said LED surround snuggly fitting around said plurality of lead tunnels and said one or more LEDs; and said lead receiver squeeze assembly can snuggly fit around a plurality of optical line holders and said plurality of lead tunnels; and a lead receiver assembly is configured for receiving and holding said light receiver end of said one or more sight pin leads in alignment with one among said one or more LEDs.

2. A range finder assembly for coupling one or more display pins with one or more LEDs, measuring a distance to a target and displaying a range display signal on said one or more display pins, comprising:

said range finder assembly comprising one or more sight pin leads having a light emitting end and a light receiver end, one or more PCBs, a range finder assembly, said one or more LEDs, a power supply, a device application and an optical coupling assembly;

said one or more PCBs comprises one or more processors and a memory;

said one or more processors are configured for executing said device application;

said device application is configured for interpreting a range signal from said range finder assembly and generating said range display signal;

said one or more LEDs generate light signals;

said one or more LEDs are selectively routed into said light receiver end of said one or more sight pin leads using said optical coupling assembly;

said light emitting end connect to said one or more display pins within bow sight;

each among said one or more display pins correspond to a bow sight aiming point of said bow sight;

said device application is configured to associate each among said one or more display pins and said one or more LEDs with a pin number and a pin range; and said range finder assembly is configured to communicate a summary of said range signal to said bow sight by sending said range display signal to said one or more LEDs, displaying said range display signal using said light signals on said one or more LEDs, routing said light signals into said light receiver end of said one or more sight pin leads using said optical coupling assembly, and displaying said range display signal on said one or more display pins.

3. The range finder assembly of claim 2, wherein:

an LED surround is configured to slide around a portion of said one or more LEDs and hold a portion of said one or more LEDs at one end and a portion of a plurality of lead tunnels at another end;

said LED surround and lead receiver squeeze assembly comprises a material selected among neoprene and rubber;

said LED surround snuggly fitting around said plurality of lead tunnels and said one or more LEDs; and said lead receiver squeeze assembly can snuggly fit around a plurality of optical line holders and said plurality of lead tunnels; and a lead receiver assembly is configured for receiving and holding said light receiver end of said one or more sight pin leads in alignment with one among said one or more LEDs.

4. The range finder assembly of claim 2, wherein:

said optical coupling assembly comprises said plurality of optical line holders, said plurality of lead tunnels, and said LED surround;

said one or more LEDs is integrated into a primary PCB;

a plurality of LED apertures in said LED surround can connect to said one or more LEDs on one side and said plurality of lead tunnels on another side;

said plurality of lead tunnels can connect to said LED surround on one side and said plurality of optical line holders on another side;

said plurality of lead tunnels comprises a light cavity for coupling said light receiver end with said one or more LEDs; and and said plurality of optical line holders can enclose said plurality of lead tunnels to ensure light from one among said one or more LEDs does not pollute another.

5. The range finder assembly of claim 4, wherein:

said LED surround and said lead receiver squeeze assembly comprises a material selected among neoprene and rubber; and said LED surround snuggly fitting around said plurality of lead tunnels and said one or more LEDs; and said lead receiver squeeze assembly can snuggly fit around said plurality of optical line holders and said plurality of lead tunnels.

6. The range finder assembly of claim 2, wherein:

said optical coupling assembly comprises said lead receiver assembly, said plurality of optical line holders, and said LED surround;

said lead receiver assembly comprises a plurality of lead receiver apertures;

said LED surround is configured to wrap around a portion of said one or more LEDs and direct said light signals into a portion of said lead receiver assembly;

said plurality of optical line holders are configured to selectively fill a portion of said plurality of lead receiver apertures;

said lead receiver assembly can extend outside of a housing;

said housing comprises a lead receiver aperture configured to allow a portion of said optical coupling assembly to selectively connect to said one or more LEDs, which is within said housing;

said plurality of lead receiver apertures are configured for receiving said one or more sight pin leads and shining light into said light receiver end of said one or more sight pin leads using said one or more LEDs;

said LED surround comprises said plurality of LED apertures configured to fit around each among said one or more LEDs.

7. The range finder assembly of claim 2, wherein:

a portion of said one or more display pins being lit by said light signals comprise one or more illuminated pins;

said device application comprises a pin lighting algorithm for calculating said range display signal;

said pin lighting algorithm comprises receiving said range signal from said range finder assembly, clearing each said one or more display pins, calculating—for each pin—a pin range delta between said range signal and said pin range, and comparing said pin range delta with values in a signal and range tolerance table to determine which among a display action to enact for each among said one or more display pins; and wherein, said display action comprises a visible signal on said one or more illuminated pins among said one or more display pins of said bow sight.

8. The range finder assembly of claim 7, wherein:

said display action comprises a selection among variations of colored lights, solid and blinking light patterns, and variations on intensity of light.

9. The range finder assembly of claim 2, wherein:

said range finder assembly further comprises one or more sensors;

said one or more sensors comprise a gyroscope; and said device application is configured for receiving one or more gyroscope signals, and adjusting display said range display signal according to a pitch of said range finder assembly.

10. The range finder assembly of claim 9, wherein:

said gyroscope comprises a multi-axis gyroscope.

11. The range finder assembly of claim 2, wherein:

said range finder assembly further comprises a display configured to display a numerical summary of said range signal.

12. The range finder assembly of claim 2, wherein:

said range display signal corresponds to lighting up one or more among said one or more display pins using said one or more LEDs associated with a target distance to said target.

13. The range finder assembly of claim 2, wherein:

said range finder assembly further comprises said one or more sensors;

said one or more sensors comprise one or more selected among said gyroscope, one or more temperature sensors, an altimeters, a location sensor, and a barometric pressure sensors;

said device application is configured for receiving one or more sensor signals from said one or more sensors and modify said range display signal according to a ballistic algorithm.

14. The range finder assembly of claim 13, wherein:

said device application is configured for receiving one or more sensor signals selected among said one or more temperature sensors, said altimeters, said location sensor, and said barometric pressure sensors, and calculating a pressure altitude for said range finder assembly, and modifying said range display signal according to said pressure altitude.

15. The range finder assembly of claim 2, wherein:

said one or more LEDs are integrated into a portion of said one or more PCBs.

16. The range finder assembly of claim 2, wherein:

said range finder assembly further comprises an activation button configured to engage said range finder assembly and said bow sight.

17. The range finder assembly of claim 2, wherein:

said one or more sight pin leads comprise fiber optic lines.

18. The range finder assembly of claim 2, wherein:

said power supply comprises a battery.

19. The range finder assembly of claim 2, wherein:

an alignment scope is configured to align said range finder assembly with respect to said bow sight aiming point.

20. A range finder assembly for coupling one or more display pins with one or more LEDs, measuring a distance to a target and displaying a range display signal on said one or more display pins, comprising:

said range finder assembly comprising one or more sight pin leads having a light emitting end and a light receiver end, one or more PCBs, a range finder assembly, said one or more LEDs, a power supply, a device application and an optical coupling assembly;

said one or more PCBs comprises one or more processors and a memory;

said one or more processors are configured for executing said device application;

said device application is configured for interpreting a range signal from said range finder assembly and generating said range display signal;

said one or more LEDs generate light signals;

said one or more LEDs are selectively routed into said light receiver end of said one or more sight pin leads using said optical coupling assembly;

said light emitting end connect to said one or more display pins within bow sight;

each among said one or more display pins correspond to a bow sight aiming point of said bow sight;

said device application is configured to associate each among said one or more display pins and said one or more LEDs with a pin number and a pin range;

said range finder assembly is configured to communicate a summary of said range signal to said bow sight by sending said range display signal to said one or more LEDs, displaying said range display signal using said light signals on said one or more LEDs, routing said light signals into said light receiver end of said one or more sight pin leads using said optical coupling assembly, and displaying said range display signal on said one or more display pins;

said optical coupling assembly comprises a plurality of optical line holders, a plurality of lead tunnels, and an LED surround;

said one or more LEDs is integrated into a primary PCB;

a plurality of LED apertures in said LED surround can connect to said one or more LEDs on one side and said plurality of lead tunnels on another side;

said plurality of lead tunnels can connect to said LED surround on one side and said plurality of optical line holders on another side;

said plurality of lead tunnels comprises a light cavity for coupling said light receiver end with said one or more LEDs; and and said plurality of optical line holders can enclose said plurality of lead tunnels to ensure light from one among said one or more LEDs does not pollute another.

* * * * *